US007780535B2

(12) United States Patent
Hagood et al.

(10) Patent No.: US 7,780,535 B2
(45) Date of Patent: Aug. 24, 2010

(54) METHOD AND APPARATUS FOR ACTIVE CONTROL OF GOLF CLUB IMPACT

(75) Inventors: Nesbitt W. Hagood, Wellesley, MA (US); Jason Horodezky, Newbury Park, CA (US)

(73) Assignee: Head Technology GmbH, Ltd.

( * ) Notice: Subject to any disclaimer, the term of this patent is extended or adjusted under 35 U.S.C. 154(b) by 275 days.

(21) Appl. No.: 10/915,804

(22) Filed: Aug. 9, 2004

(65) Prior Publication Data

US 2005/0037862 A1 Feb. 17, 2005

Related U.S. Application Data

(60) Provisional application No. 60/494,739, filed on Aug. 14, 2003.

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |

(52) U.S. Cl. ..... 463/47; 463/50; 463/53; 463/56; 463/57; 463/63; 473/324

(58) Field of Classification Search ..... 473/324; 463/47, 50, 53, 56, 57, 63
See application file for complete search history.

(56) References Cited

U.S. PATENT DOCUMENTS

| | | | | |
|---|---|---|---|---|
| 3,194,562 | A * | 7/1965 | Speiser | 473/199 |
| 3,819,963 | A | 6/1974 | Kondo et al | |
| 4,091,302 | A | 5/1978 | Yamashita | |
| 4,387,318 | A | 6/1983 | Kolm et al. | |
| 4,442,372 | A | 4/1984 | Roberts | |
| 4,453,205 | A * | 6/1984 | Brakus | 363/8 |
| 4,467,236 | A | 8/1984 | Kolm et al. | |
| 4,504,761 | A | 3/1985 | Triplett | |
| 4,595,856 | A | 6/1986 | Glomb, Jr. | |
| 4,679,178 | A * | 7/1987 | Larsen et al. | 367/157 |
| 4,940,236 | A * | 7/1990 | Allen | 473/223 |
| 5,216,316 | A * | 6/1993 | Ipcinski | 310/338 |
| 5,424,624 | A * | 6/1995 | Senak, Jr. | 318/701 |
| 5,441,269 | A * | 8/1995 | Henwood | 473/220 |
| 5,512,795 | A | 4/1996 | Epstein et al. | |
| 5,552,657 | A | 9/1996 | Epstein et al. | |
| 5,607,361 | A * | 3/1997 | Mastandrea et al. | 473/207 |
| 5,703,474 | A | 12/1997 | Smalser | |
| 5,792,001 | A * | 8/1998 | Henwood | 473/224 |

(Continued)

*Primary Examiner*—John M Hotaling, II
*Assistant Examiner*—Adetokunbo Torimiro
(74) *Attorney, Agent, or Firm*—Leonard Tachner

(57) ABSTRACT

A method and apparatus for actively controlling the impact between a club head and a golf ball. A golf club head has a face with an actuator material or device mechanically coupled to influence face motion. The face actuation controls impact parameters, impact properties, or resulting ball parameters such as speed, direction and spin rates resulting from the impact event between the face of the club and the golf ball. Further, the apparatus has a control device for determining the actuation of the face. Several embodiments are presented for controlling parameters such as ball speed and direction. The invention can use energy derived from the ball impact, converted into electrical energy, and then reapplied in a controlled fashion to influence an aspect of the face, such as position, velocity, deformation, stiffness, vibration, motion, temperature, or other physical parameter.

38 Claims, 26 Drawing Sheets

U.S. PATENT DOCUMENTS 6,048,276 A 4/2000 Vandergrift
6,086,490 A 7/2000 Spangler et al.
6,102,426 A 8/2000 Lazarus et al.
6,149,532 A * 11/2000 Kim ..... 473/221
6,196,932 B1 * 3/2001 Marsh et al. ..... 473/223
6,196,935 B1 * 3/2001 Spangler et al. ..... 473/318
6,248,021 B1 * 6/2001 Ognjanovic ..... 473/131
6,362,557 B1 * 3/2002 Gruber et al. ..... 310/323.02
6,485,380 B2 11/2002 Spangler et al.
6,974,397 B2 * 12/2005 Lammer ..... 473/521
2002/0160131 A1 * 10/2002 Ohira et al. ..... 428/35.7
2003/0199335 A1 * 10/2003 Bissonnette et al. ..... 473/342

* cited by examiner

Piezoelectric Shear Mode of Operation

METHOD AND APPARATUS FOR ACTIVE CONTROL OF GOLF CLUB IMPACT

CROSS-REFERENCE TO RELATED APPLICATIONS

This application claims priority from U.S. Provisional Patent Application Ser. No. 60/494,739 filed Aug. 14, 2003.

BACKGROUND OF THE INVENTION

1. Field of the Invention

The present invention pertains to the field of advanced sporting equipment design and in particular to the design and operation of a golf club head system for control of the impact between a club head and a golf ball.

2. Background Art

The present invention pertains to achieving an increase in the accuracy and distance of a golf club(e.g., a driver) through the application of controls techniques and actuation technology to the design of the club. There have been many improvements over the years which have had measurable impact on the accuracy and distance which a golfer can achieve. These have typically focused on the design of passive systems; those which do not have the ability to change any of their physical parameters under active control during the swing and in particular during the impact event with the golf ball. Typical passive performance improvements such as head shape and volume, weight distribution and resulting components of the inertia tensor, face thickness and thickness profile, face curvatures and CG locations, all pertain to the selection of optimum constant physical and material parameters for the golf club. The present invention pertains to the development of an active system where critical parameters of the golf club and head (for example surface position/shape/curvature or effective coefficient of friction, or face stiffness) can be selectively controlled in response to the actual state of the physical head-ball system. Such states can be head velocity, impact force, intensity, impact duration and timing, absolute location of the head or relative location of the ball on the face, orientation of the head relative to the ball and swing path or parameters, physical deformation of the face, or any of numerous physically or electrically measurable conditions.

The present invention relies on the field of controls technologies and in particular structural or elastic system actuation technologies and control algorithms for such systems. See for example: Fuller, C. R. et al., *Active Control of Vibration* Academic Press, San Diego, Calif. 1996. A particular embodiment of one controlled system relies on friction control using ultrasonic vibration (Katoh). An alternate embodiment of one controlled system relies on changing the effective stiffness of the face to control impact with the ball. The present invention also relies on the concept of piezoelectric energy harvesting and/or simultaneous energy harvesting from and actuation of mechanical systems. Piezoelectric energy harvesting is described in the following U.S. Pat. Nos. 4,504,761; 4,442,372; 5,512,795; 4,595,856, 4,387,318; 4,091,302; 3,819,963; 4,467,236; 5,552,657; and 5,703,474.

The impact between the ball and the head can be interpreted in terms of the idealized impact between two elastic bodies each having freedom to translate and rotate in space i.e. full 6 degrees of freedom (DOF) bodies, each having the ability to deform at impact, and each having fully populated mass and inertia tensors. The typical initial condition for this event is a stationary ball and high velocity head impacting the ball at a perhaps eccentric point substantially on or substantially off the face of the club head. The impact results in high forces both normal and tangential to the contact surfaces between the head and the ball. These forces integrate over time to determine the speed and direction, forming velocity vector and spin vectors of the ball after it leaves the face, hereafter called the impact resultants. These interface forces are determined by many properties including elasticity of the two bodies, material properties and dissipation, surface friction coefficients, body masses and inertia tensors.

Some of these properties and conditions of the face can be actively controlled during the impact resulting in some measure of control over the impact resultants. For example, in a specific embodiment, the surface can be ultrasonically vibrated under some predetermined condition so as to create an effectively lower friction coefficient between the ball and the face resulting in decreased spin rates and longer flight of the ball when a trigger condition is present. One such trigger condition might be high head ball impact forces (and large face deformation), indicating a high velocity impact where too much spin could create excess aerodynamic lift producing a decreased flight distance.

In another embodiment, the position and/or orientation of the face can be actively controlled relative to the ball and the body of the club under some predetermined condition so as to create a better presentation of the face to the ball for more accurate ball flight or to reduce side spin by counteracting club head rotation during eccentric impact events. One such triggering condition might be highly eccentric impact events (off center hits) that can be detected by deformation sensors on the face or angular acceleration sensors in the body. Such sensor signals could be processed to determine the necessary motion of the face to compensate and correct the resulting ball flight.

In another embodiment, the effective stiffness of the face during impact can be controlled so as to produce a more desirable impact event. For example, the system can be designed to make the face stiffer during a hard impact and make the face softer during a less intense impact so as to tailor the face behavior under the impact loads to the particular event. This can be accomplished by, for example, shorting or opening the leads of a piezoelectric transducer which has been surface bonded or otherwise mechanically coupled to a face. The piezoelectric is softer (low modulus) when it is electrically shorted and stiffer (high effective modulus) when it is open circuited. A sensor attached to the face can measure a quantity proportional to impact intensity (e.g., face deflection, face strain, head deceleration etc). In the "hard" hit case, the normally shorted piezoelectric can be open circuited to make the face stiffer, while softer hits result in the circuit leaving the piezoelectric in the short circuited condition and therefore less stiff.

The trigger can be provided by an external sensor or by the actual piezoelectric transducers bonded to the face itself by triggering off of the current or voltage level achieved on the transducer prior to the triggering event. As an example, circuitry for using the piezoelectric element as a charge sensor can be attached to the transducer leads. When the charge reaches a critical level a circuit can be triggered which disconnects the leads from the circuitry effectively enforcing the open circuit condition.

A critical element of the ability to control the ball-head impact is the ability to actuate the system in a beneficial manner. Since the head and ball are a mechanical system, this entails the application of some force or thermal energy to the system so as to create a change in some mechanical physical attribute. The present invention pertains principally to mechanical actuation techniques.

U.S. Pat. No. 6,102,426 to Lazarus, et. al, discloses the use of a piezoceramic sheet on a ski to affect its dynamic performance such as limiting unwanted vibration at higher speeds or on irregular surfaces. The disclosure mentions the application to golf clubs to dampen vibrations or alter shaft stiffness or "to affect its head".

U.S. Pat. Nos. 6,196,935, 6,086,490 and 6,485,380 to Spangler et. al, disclose the use of piezoceramic sheets on golf clubs to alter stiffness and to effect a dampening of vibration. FIG. 9G illustrates the placement of piezo elements on a golf club head to capture strain energy to be dissipated in a circuit for a dampening effect.

U.S. Pat. No. 6,048,276 to Vandergrift relates to the use of piezoelectric devices to stiffen the shaft of a golf club after capturing energy from the swinging and flexing of the shaft.

The issue of reducing friction using ultrasonic vibration is discussed by Katoh in an article entitled "Active Control of Friction Using Ultrasonic Vibration" Japanese Journal of Tribology Vol. 38 No. 8 (1993) pp 1019-1025. See also K. Adachi et al "The Micromechanism of Friction Drive with Ultrasonic Wave", Wear 194 (1996) pp 137-142.

SUMMARY OF THE INVENTION

The present invention pertains to a system for the control of the impact event between the ball and the club face using actuation and control of the face position or properties to influence the progression of the impact event between the ball and the face. In particular, it pertains to the reuse of energy generated and converted to electrical energy from the mechanical energy of the impact event. Such reuse beneficially controls the impact event. In a particular embodiment, the energy converted from impact by a piezoelectric element is converted into ultrasonic face deformations/oscillations which have the ability to effectively lower the friction coefficients between the ball and the face. In an alternate embodiment, the stiffness of the piezo-coupled face under impact is controlled to a certain behavior upon the occurrence of predetermined impact parameters. For example, the face is made stiff under hard hits and soft under lower intensity hits. All these cases pertain to putter, drivers and irons equally and club-head will be taken to mean all of these without prejudice.

The face actuator can be any of a number of actuators capable of converting electrical energy to mechanical energy. These include electromagnetic types such as a solenoid, as well as a family of actuation technologies using electric and magnetic induced fields to effect material size changes; electrostrictive, piezoelectric, magnetostrictive, ferromagnetic shape memory alloys, shape memory magnetic and shape memory ceramic materials, or composites of any of the above. Included in the possible actuation schemes are thermal actuators using resistive heating or shape memory alloys which use applied thermal energy to induce a phase change within the material to induce a resulting size change or stress. All can be used to convert electrical energy into face deformation or face positioning in a controlled fashion.

In such a system using a pure actuator there must be an electric energy source, battery or other electrical generator converting motion or impact energy into the electrical energy which is used by the face actuator. The system can include a power source, electronics, and an actuator mechanically coupled to the head.

In a further definition there is alternately a class of system in which a transducer is coupled to the face. A transducer is capable of generation of electrical energy from mechanical energy as well as vice versa. Examples of transducer materials include electromagnetic coil system, piezoelectric and electrostrictive materials operating under a biased electric field, and magnetic field biased magnetostrictive materials and ferromagnetic shape memory alloy materials, and or composites of the above with themselves or other constituents. These will hereafter be called piezoelectric materials generally and the use of the word piezoelectric shall in no way be taken as limiting. In systems employing such transducers, the transducer element can be coupled to the face such that deformation or motion of the club generates electrical energy which can be used via the converse actuation function to control aspects of the head-ball impact.

Piezoelectric actuators are the most common of the class of transducer materials. In general, they change size in response to applied electric field and conversely they generate charge in response to applied loads and stress. They can be used both as electrically driven actuators and electrical generators.

Control of the impact involves putting forces on the head and/or face so as to beneficially change a property of the system which influences the impact event. For example, if the force applied is proportional to the face acceleration, then the control acts to apparently increase the mass or inertia of the system. It does this by putting the same force on the head that a mass at that location would put under that particular face motion. The applied force can be applied to effectively create forces which mimic elastic and dissipative as well as inertial forces of the system. For example, if the force put in the center of the face were to be proportional to the velocity and opposing the velocity at the center of the face, then it would effectively act as a dashpot at the center of the face and create a viscous damper at the center of the face. Similarly, if one could apply a force which was essentially proportional and opposed to the deflection of the center of the face, then it would look like a spring applied at the center of the face—effectively stiffening it. Likewise if the force was proportional and in the direction of the deflection then it would look like a negative spring applied at the center of the face—effectively softening the face. The actively controlled system (if one can control the force), can mimic many different dynamic effects in the system. The challenge is to develop a device and system which can put those types of forces on the system even if some other constraints prohibit that.

The idea of applying some forces that mimic other types of forces that would result from inertias or masses, is one manifestation of the forces that can be applied. In such control systems there can be an arbitrary phase relationship between the applied force and input and that relationship can be frequency dependent. Essentially the control function can be a linear or nonlinear dynamic system between some sensor and the output force applied by the actuator. In a classic controlled system, there is a control system which takes sensor outputs and puts forces on the body to achieve some desired effect. That's the general area of dynamic systems control and more specifically, structure control for elastic systems and is well defined in the art.

Ultrasonic, or high frequency, oscillations of contacting surfaces can result in lower effective coefficients of friction between the two surfaces. The oscillations must be of sufficient amplitude and frequency such that the surfaces lose contact briefly during at least one portion of the oscillation. This breaking of contact lowers the effective coefficient of friction.

An actuator coupled to the club face can be configured to excite high frequency oscillation of the face when driven with high frequency electrical input. If the excitation occurs at a frequency at or near a resonant frequency of the club/face body, then the amplitude can be maximized.

In scenarios such as a golf ball impact where the normal forces are high during impact, the key requirement is that the acceleration of the face away from the ball during the oscillatory motion should be high enough that the ball cannot "catch up" and surface contact is broken. The acceleration is proportional to the amplitude of the oscillatory motion multiplied by the square of the excitation frequency. This can be considered a figure of merit of the design of the actuation system. Since the amplitude of oscillation for an actuated system tends to roll off due to system inertial effects, there is a tradeoff between driving at higher frequency and achieving the highest possible oscillatory amplitude. The figure of merit helps balance these to maximize the friction control effect. For example, in the preferred embodiment of the present invention, it was found advantageous to excite a face surface mode at 120,000 Hz which is coupled to the actuation driver described hereinafter.

In systems where an external source of power is not available, a portion of the energy of impact (converted from mechanical to electrical by a transducer coupled to the face) can be stored and returned to the face in the form of ultrasonic excitation of a high order face mode, high frequency oscillations of the face which are well coupled to the transducer. The energy can be stored in the transducer material itself, for example in the charge stored in the capacitance of a piezoelectric material or it can be stored primarily in auxiliary circuit elements such as storage capacitors or inductors or tank circuits, etc, which are electrically coupled to the transducer. After a triggering effect releases the energy, an electrical drive circuit can be configured so that when connected to the transducer, it induces a high amplitude face oscillation which effectively reduces the impact friction coefficient between the ball and the face at a critical point in time during the impact event such critical point in time being selected by a control algorithm. The face oscillation and controlled friction result in a control of ball spin which can be selectively triggered under certain impact conditions (such as high impact force levels).

The exiting ball speed can also be controlled by applying forces to the face proportional to face deflection. With appropriate sign these forces can effectively soften the face by increasing the duration of the impact thereby lessening the impact loading and resulting ball deflection. The lower ball deflection results in reduced dissipation by inelastic deformation of the ball and increased recoverable energy from the impact event, thus achieving higher coefficients of restitution (COR) and higher ball velocities. Conversely, impact energy converted into electrical energy can be dissipated to decrease the effective COR in selected impact scenarios.

By selectively applying forces electrically to mimic the effects of tailored compliance, portions of the face can be selectively made to deform greater than others during the impact event thus controlling the exit direction of the ball. The exit direction is controlled because the final ball velocity (speed and direction) is determined by the forces generated by the elastic impact. Uneven deformation of the face (due to unbalanced compliance) changes the direction of the normal reaction of the ball and therefore the final direction the ball will travel. In addition to this direct control of ball direction, indirect control of ball direction can be achieved by reducing spin including sidespin and thereby reducing cross range travel. Similar control features can be achieved by actively positioning an actuated clubface during impact in response to some measured impact variable such as location of the impact or angular acceleration of the head (caused by eccentric impact).

Forces can also be applied to the head to mimic the effects of a higher moment of inertia. In other words, the forces would be similar to those that an additional mass at a given location would exert on the head during impact. Such forces can be triggered in miss hit scenarios resulting in straighter shots. For instance, one way of doing that would be to create a force on the head through action with a reaction mass. The actuator reacts between the head and the reaction mass. It reacts in such a way that it minimizes head rotation under impact. It acts to effectively increase the moment of inertia of the body and therefore keeps the face straighter and therefore the ball flight straighter during the impact event. Because the impact event is of a finite duration, one can put that kind of force on the body within that finite duration. A central post and an annular bimorph ring would be segmented so that one can actually detect and sense which way the head is moving relative to the reaction mass. Whether it is up, down, left or right, basically which way the face is rotating could be used as a sensor input to a compensator/controller to allow the applied force to compensate for that resulting face motion. Multiple piezo elements or configurations with multiple electrodes on a single piezoelectric element would allow detection of a broader range of impacts. One can actually determine where the ball is impacting on the face and use the control circuitry to compensate accordingly, for instance by slightly rotating the face to compensate for head rotation during eccentric impacts. In the preferred embodiment there is one voltage coming out of one piezo making it difficult to determine the impact location from the variety of possible impact locations. But that is not necessarily a limitation of the present invention. It is possible to include a uniform piezo bonded to the face where the electrodes are segmented to allow detection of impact location. In that scenario, essentially there would be multiple piezoelectric elements that are bonded to the face. There would be multiple electrodes for example in a square array. For example there might be actually nine electrode patterns in a 3×3 square array on the back of the face. Those voltages would be applied to a control circuit that would determine where the ball has impacted and the resulting appropriate response to that impact. Switching on the voltage on some of the electrodes on the transducers as opposed to others in response, could tailor the response depending upon impact location.

BRIEF DESCRIPTION OF THE DRAWINGS

The various embodiments, features and advantages of the present invention will be understood more completely hereinafter as a result of a detailed description thereof in which reference will be made to the following drawings.

DETAILED DESCRIPTION OF PREFERRED EMBODIMENTS

The following description assumes that there is an understanding of the fundamentals of piezoelectric materials, operations and modes such as described in "Piezoelectric Ceramics" by Jaffe, Cook and Jaffe, Academia Press, 1971 and the references cited therein. The content of that publication is hereby incorporated herein in its entirely by reference. Another useful reference which describes the field of piezoelectric mechanics is "Piezoelectric Shells" by H. S. Tzou, Kluwer, Academic Publishers, MASS., 1993 and is also hereby incorporated herein by reference.

Actuator Coupling to Face

There are several methods of coupling actuation elements and transducers to the club face, the interaction surface between the ball and the head. The transducer can be directly coupled to 1) the face relative deformation (elastic), 2) absolute motion (inertial) using a variety of techniques or 3) relative motion between the face and the head body. Eight are described here which alternately couple the actuator or transducer to elastic deformation of the face or inertial motion of the head. For the actuation function the goal is to enable maximal control over face deflection at the desired frequency of actuation. For the transducer, the goal is to maximally couple into either the absolute motion (deceleration) of the head (or face) or into the deformation pattern induced in the head and face by the ball impact. The two techniques tap into the pool of kinetic or elastic energy available during impact. This energy is then converted by the transducer into electrical energy which is usable for face and interface actuation. A description of eight alternative systems for coupling a transducer element to the golf club face follows.

Figure 1:
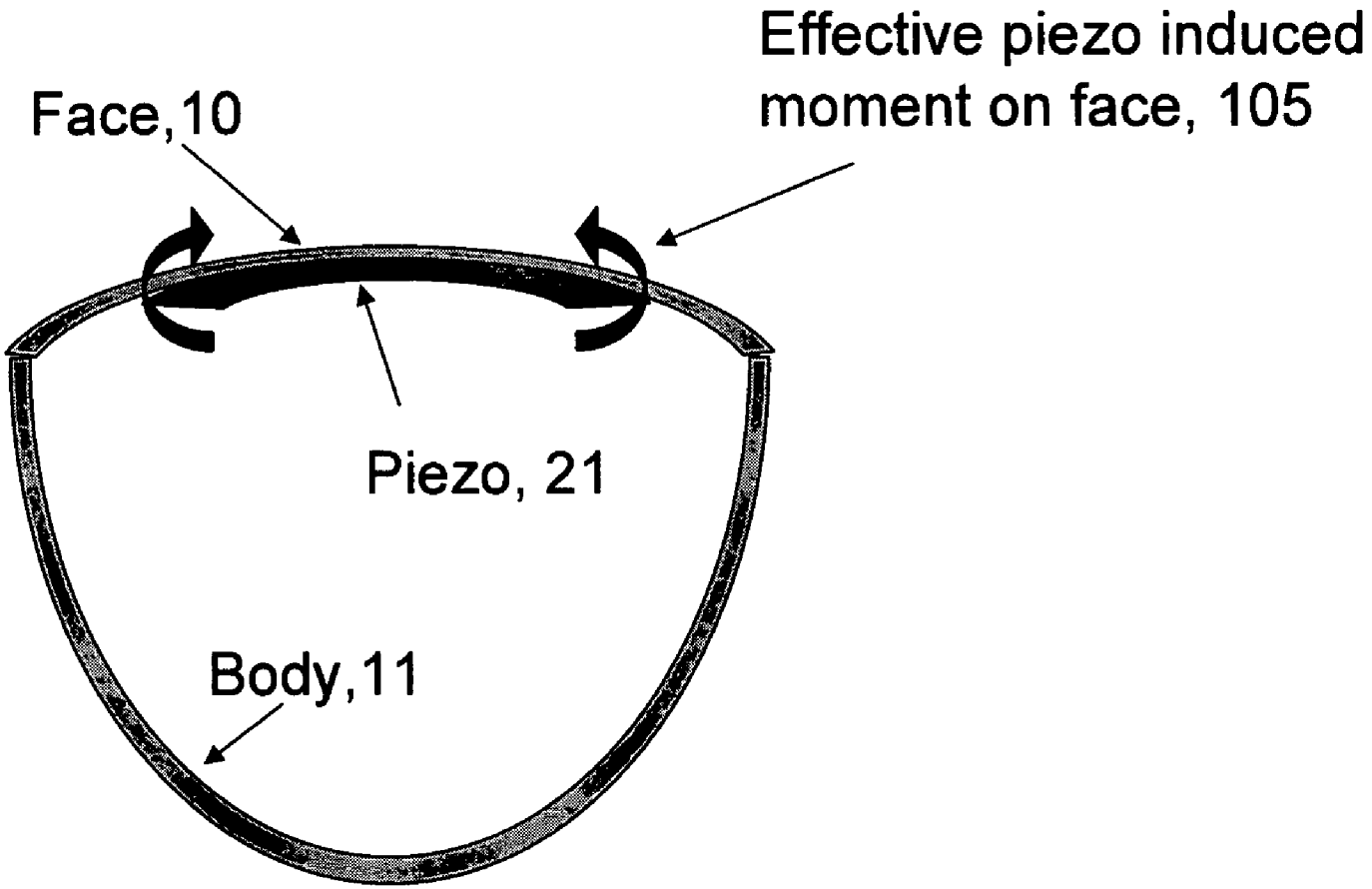
FIGS. 1-5 illustrate various conceptual embodiments of the invention wherein different forms of elastic coupling of a piezoelectric actuator to a golf club head face are shown.
Figure 2A:
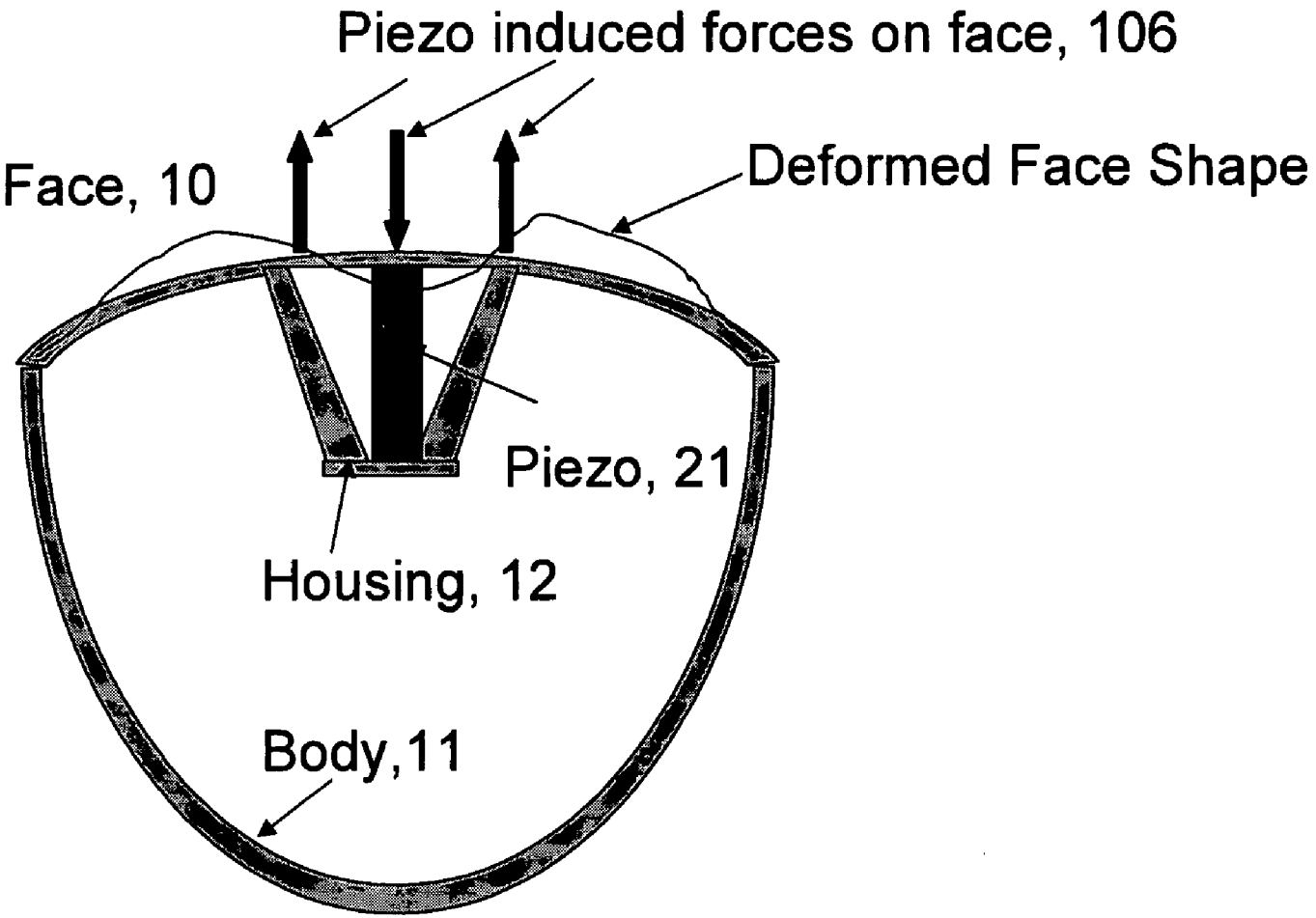
Figure 2B:
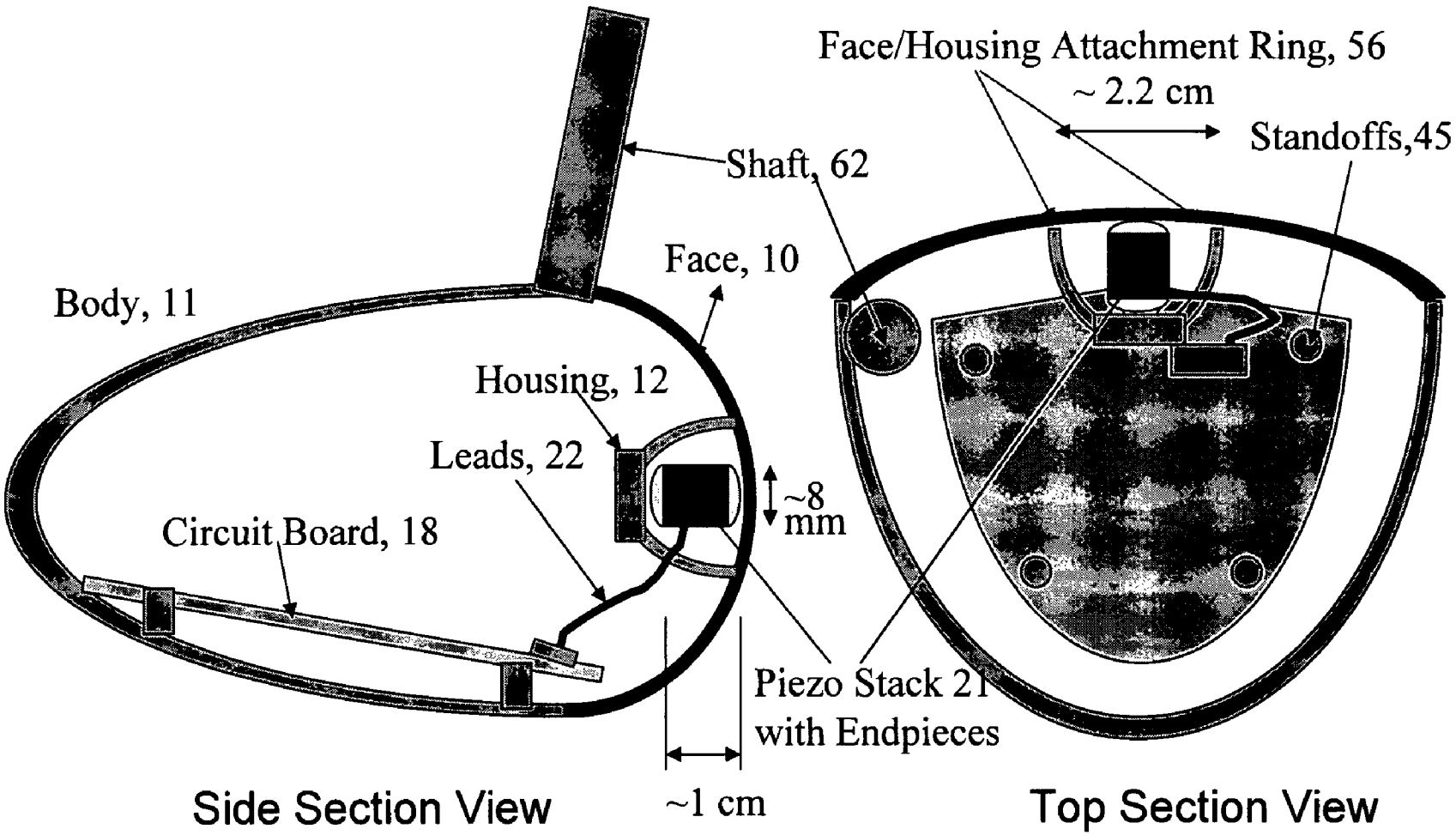
Figure 3:
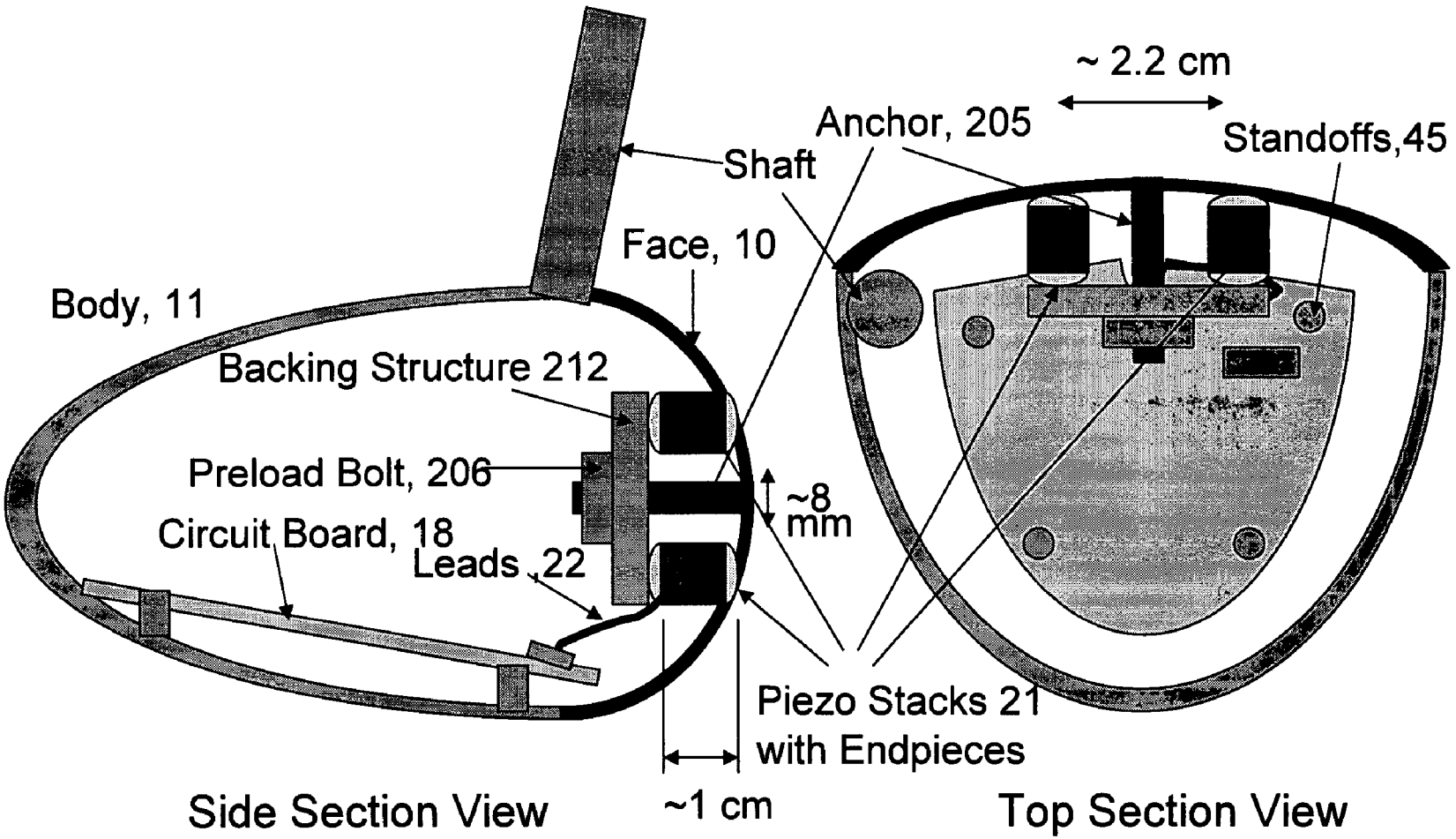
Figure 4:
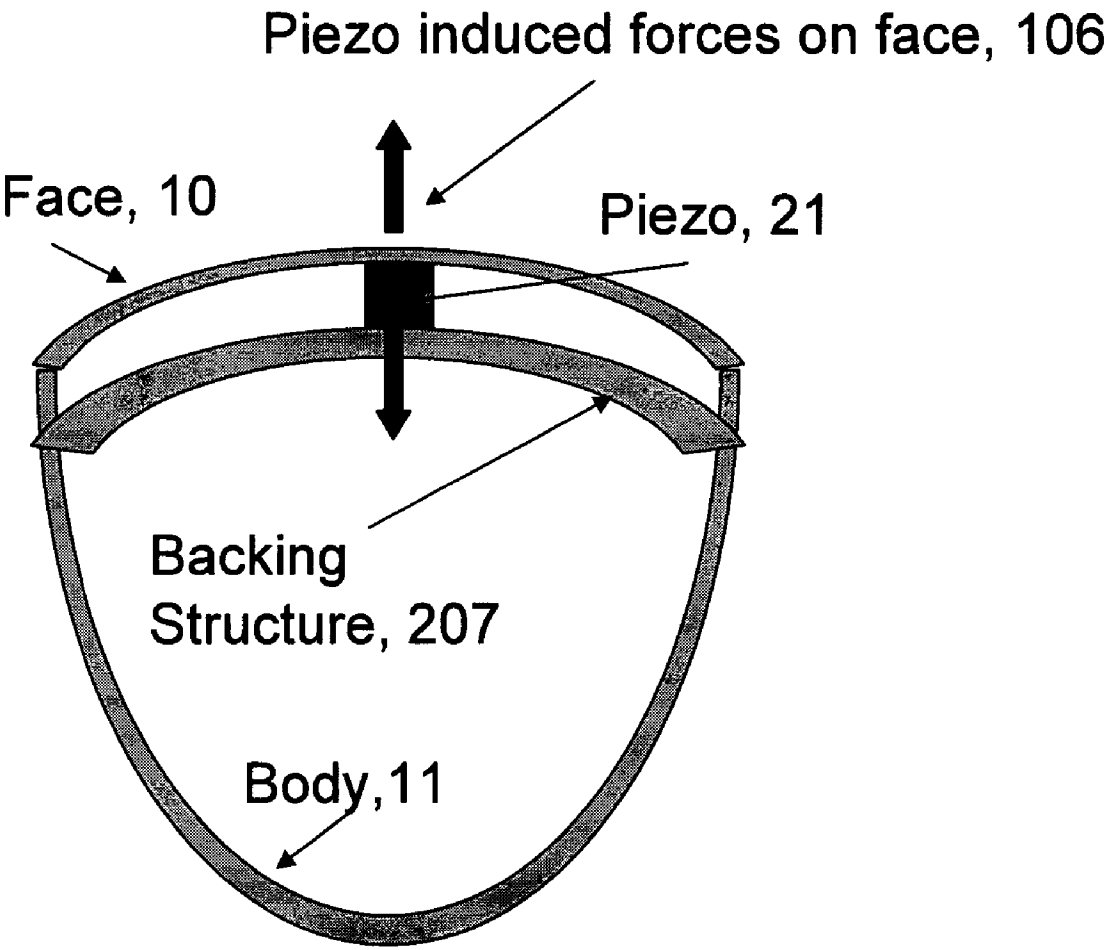
Figure 5A:
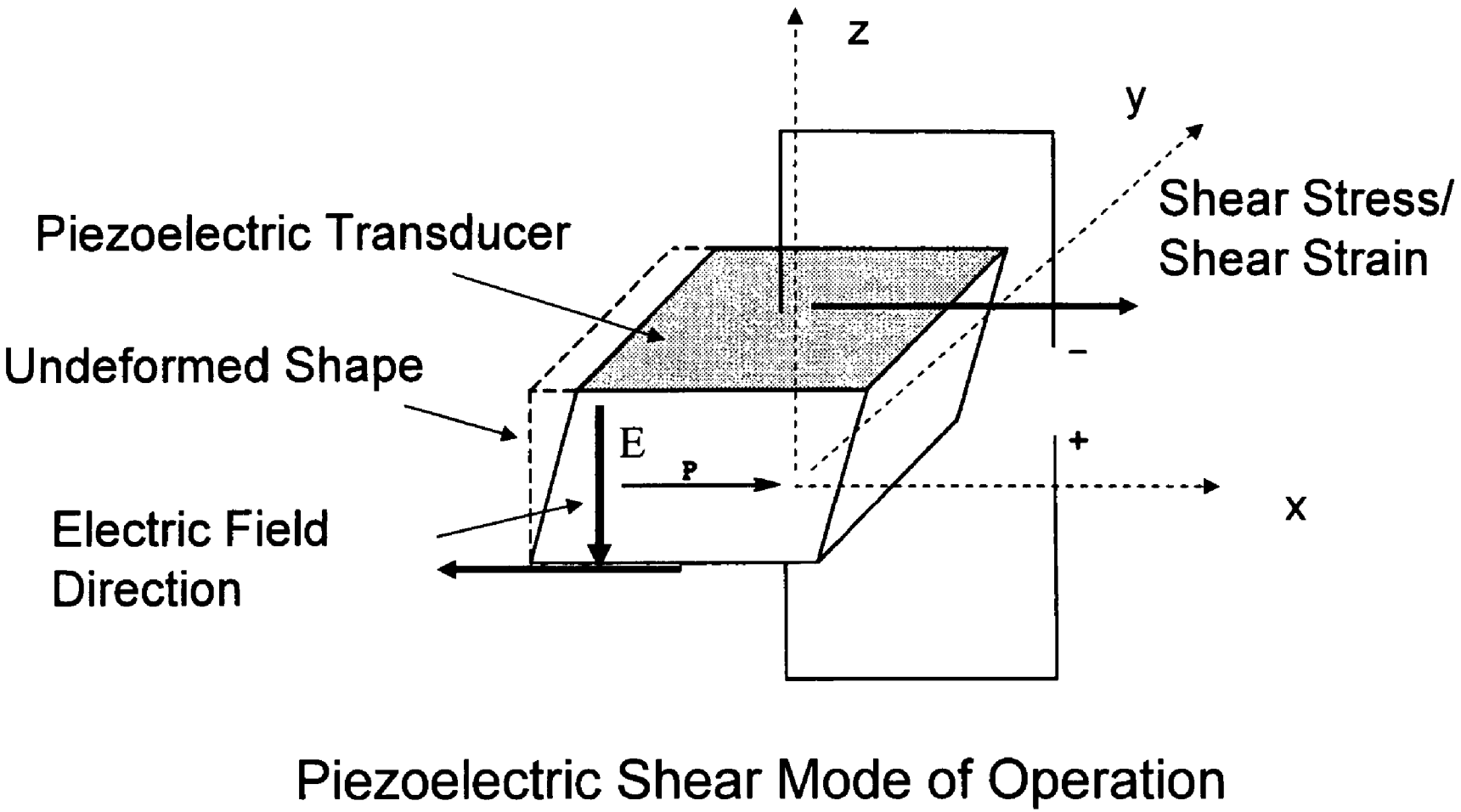
Figure 5B:
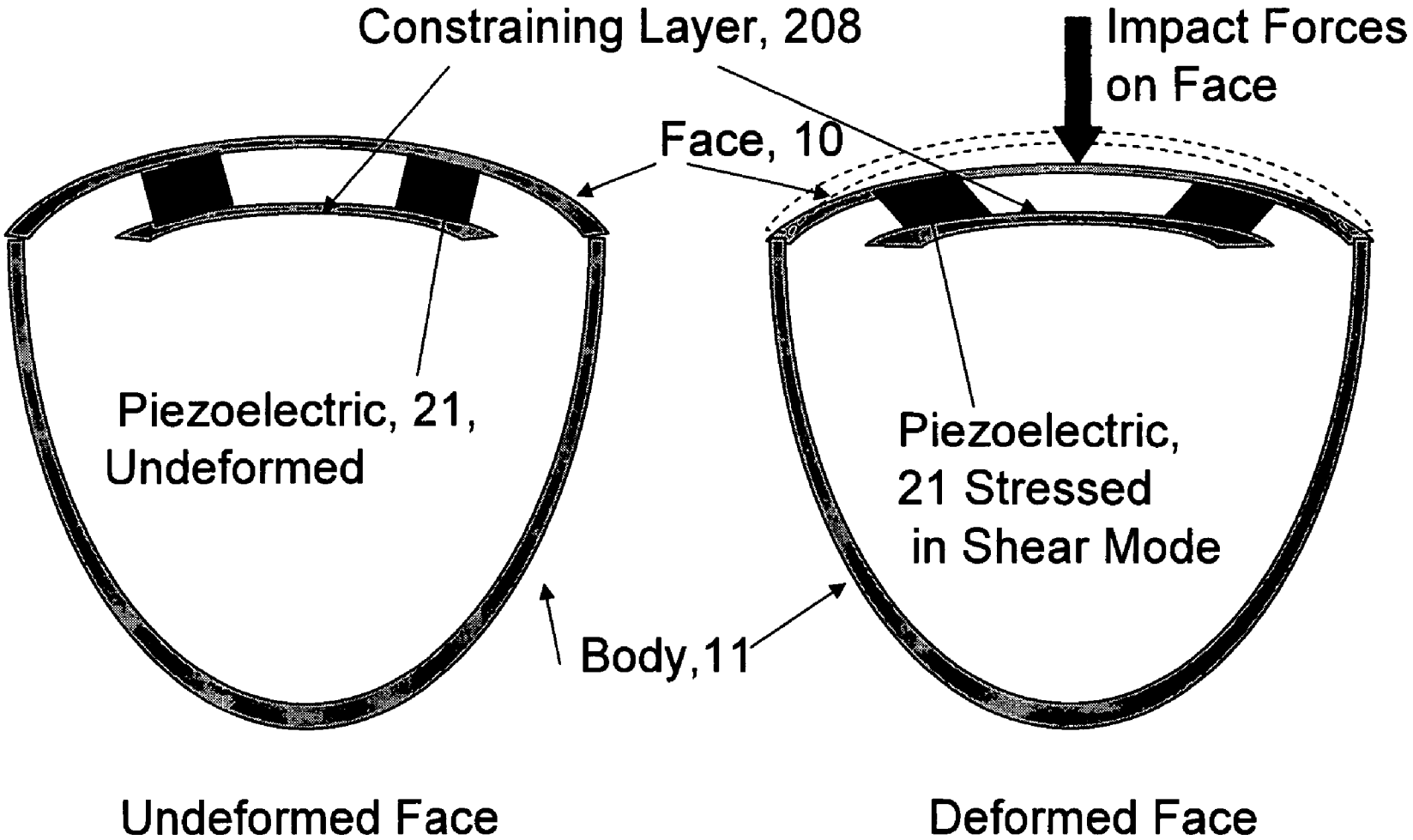

There are three classes of actuator face coupling. The first class pertains to elastic piezo face actuation wherein transducer size changes and deformations are directly mechanically coupled into relative deformation along or between two structural points on the face. This type of elastic actuation is generally known in the art of structural control where piezoelectric elements (predominately) are mounted on or embedded within structures to effect beneficial structural deformation. The four embodiments of elastically coupled actuators are as follows:

- Concept 1—Piezo wafer attached directly to the face to actuate bending as shown in FIG. 1.
- Concept 2—Piezo stack and/or tube mounted on the face with housing as shown in FIGS. 2*a*, 2*b* and 3.
- Concept 3—Piezo disposed between the face and a stiff backing as shown in FIG. 4.
- Concept 4—Piezo operated in shear mode and disposed between the face and a stiff constraining layer as shown in FIGS. 5*a* 5*b*.

Figure 6:
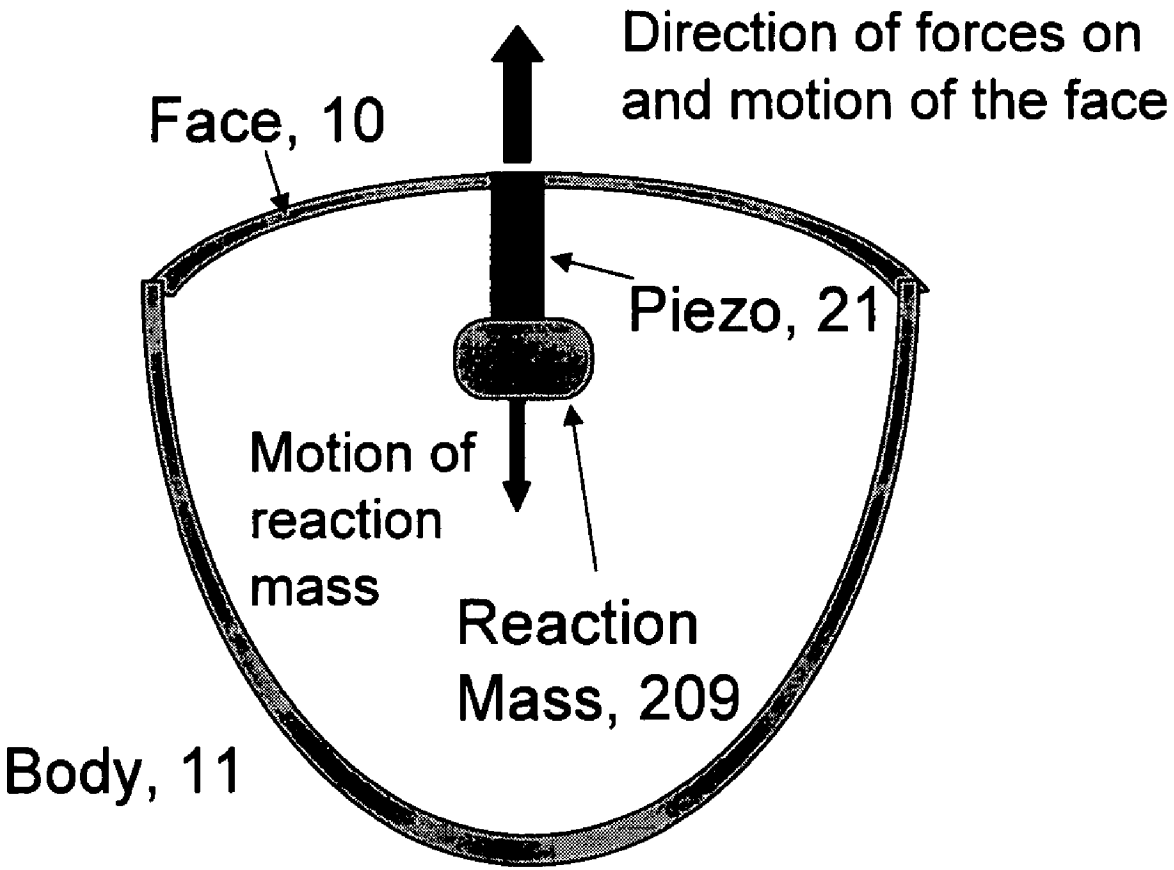
FIGS. 6-8 illustrate various conceptual embodiments of the invention wherein different forms of inertial coupling of a piezoelectric actuator to a golf club head face are shown.
Figure 7:
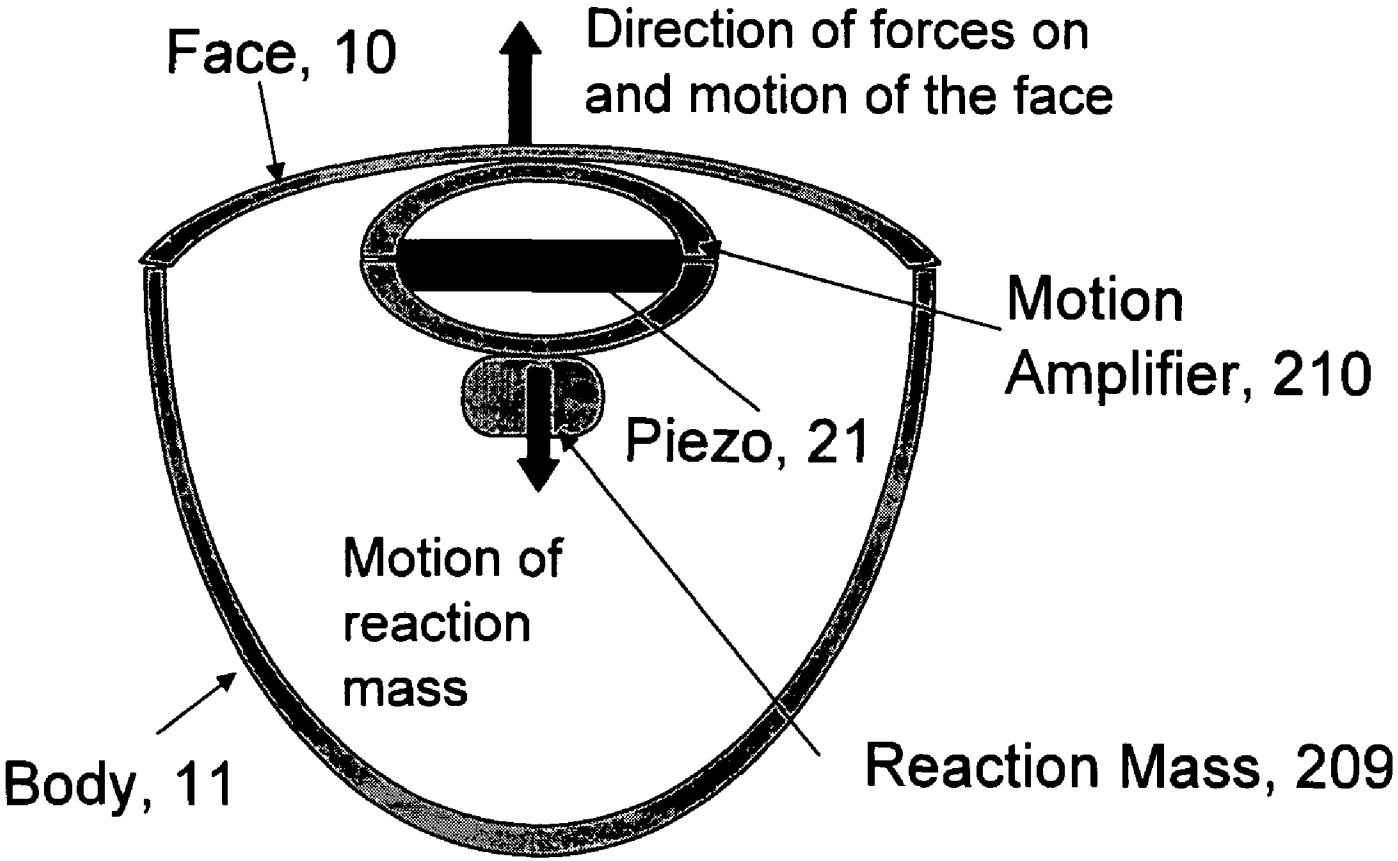
Figure 8:
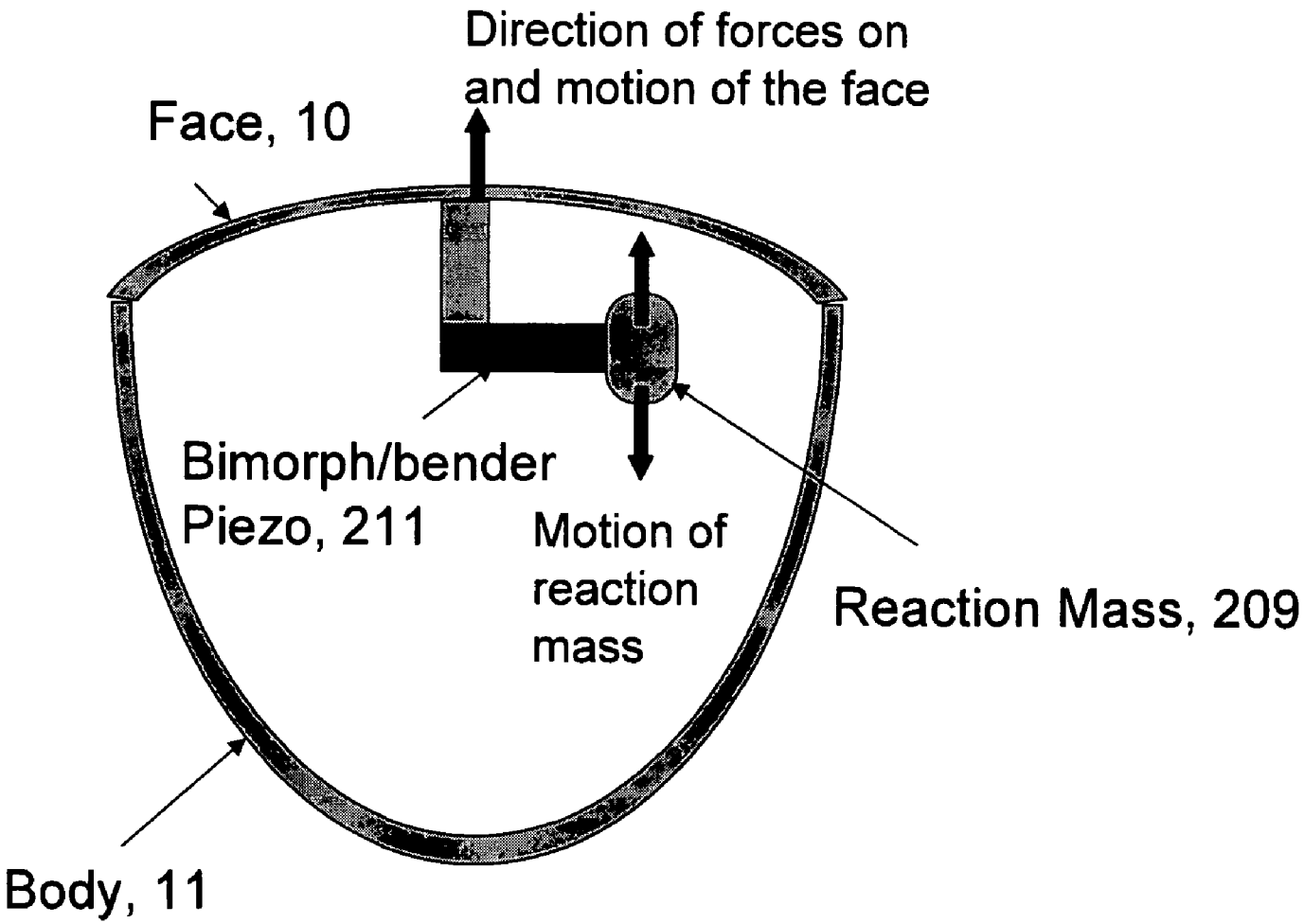

The second class of actuator face coupling is actuator coupling to the face's absolute motion or those that rely on inertial forces generated by face and head motion on impact with the ball. These typically entail a reaction mass and an actuator or transducer element acting between the reaction mass and the face. These types of face couplings are generally related to proof mass or reaction mass actuators. The concepts in this category are described as follows:

- Concept 5—Direct piezo coupled between the face and an inertial mass as shown in FIG. 6.
- Concept 6—Motion amplified piezo between the face and an inertial mass as shown in FIG. 7.
- Concept 7—Bimorph type piezo with tip mass and mounted on the face as shown in FIG. 8.

The third class of actuator-face coupling is actuator coupling between the face and the body of the club. The actuator can be the sole or one of a number of parallel load paths between the face and the body. This is similar to Concept 3 but the face is treated more like a rigid body that can be positioned rather than deformed as in Concept 3. The transducer positioned between the face and the body supports the majority of the loads between the face and the body and can therefore participate to a large extent in the impact event. In addition, actuation induced positioning of the face relative to the body in essence uses the body itself as a large reaction mass to effect changes in the location or orientation of the face during impact.

Figure 9:
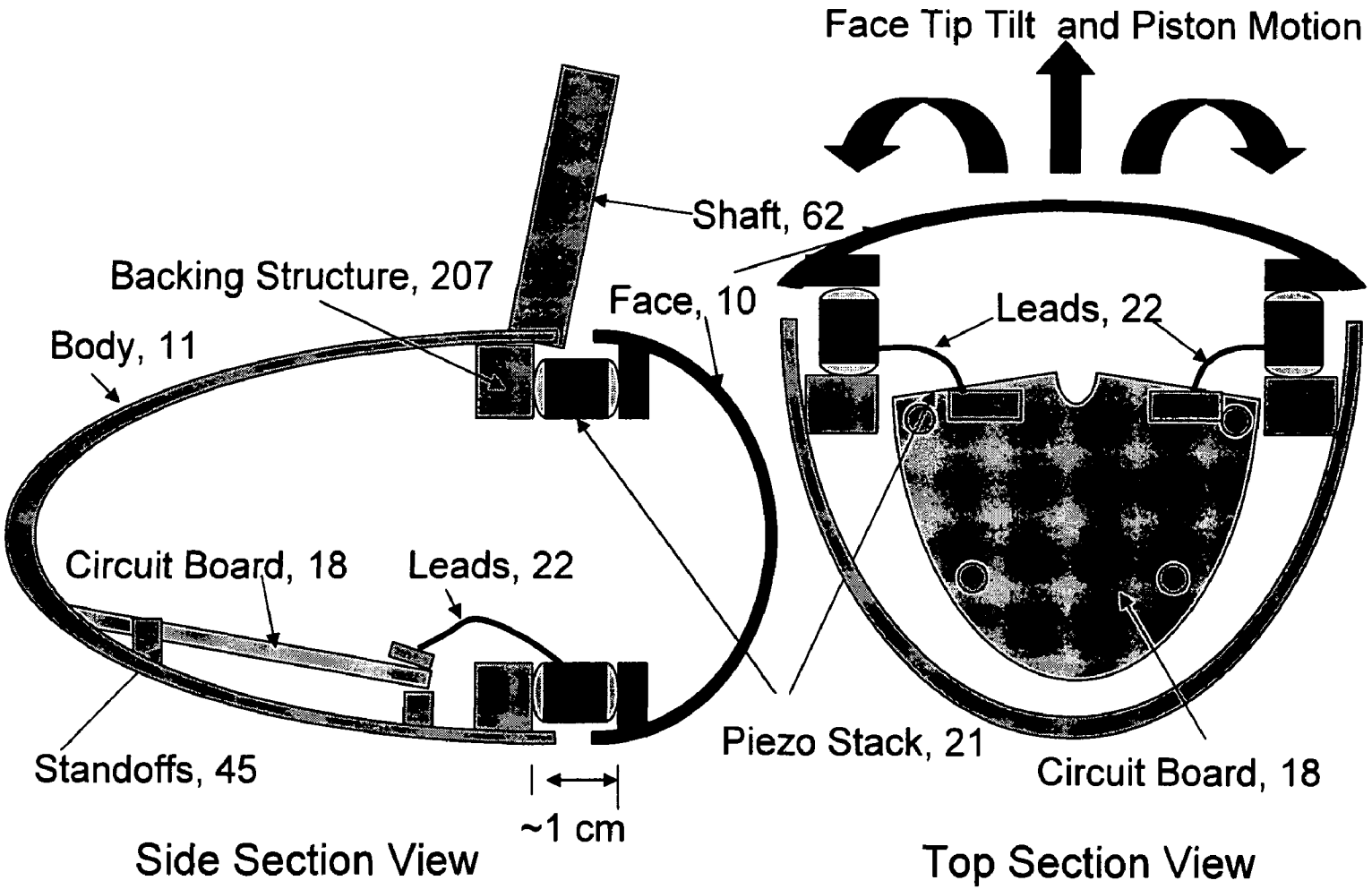
FIG. 9 illustrates a conceptual embodiment of the invention wherein piezoelectric transducers are disposed between the face and body of the club positioning the face relative to the body.

- Concept 8—piezoelectric transducer positioned between the face and body of the club as shown in FIG. 9.

For transducer applications, to produce maximal available actuation power and maximally available coupling (for instance actuating high amplitude high frequency face oscillations for spin control) it is desirable to achieve good coupling to both 1) impact deformation pattern as well as 2) a high frequency mode. For face positioning applications (rather than friction reduction applications) it is desirable to achieve good coupling to both 1) impact loading patterns as well as 2) impact-timescale motion between the face and the body.

In general for the elastically coupled concepts (1-4), face motion/loading generates loading on the transducer material and corresponding electrical energy generation. Conversely, electrical energy put on the transducer controls face motion. It is desirable to have high electro-mechanical coupling between face loading/motion and electrical voltages and currents. This coupling can be measured in terms of the fraction of input mechanical energy from the impact that is converted into stored electrical energy (for instance on the piezoelectric element or a shunting circuit) or conversely, by the fraction of input electrical energy that is converted into strain energy in the actuation induced deformation of the face.

Concept 1

In this face coupling embodiment an actuator, 21, capable of planar size changes, (also called a 3-1 actuator, although a variety of interdigitated piezoelectric wafer or composite actuators are capable of planar size changes) is coupled to the plane of the face, 10, onto or buried within the face itself. The actuator can also be packaged using techniques known in the art. Since the actuator is not exactly on the centerline, it couples into bending deformation of the face and acts to impact a bending moment on the face, 105, when electrically excited. Alternately for in plane actuators near the centerline coupled preferably into in plane deformation rather than bending, coupling into out-of-plane motion can be achieved in large deformation scenarios using parametric forcing. The actuation loading can be thought of as a combination of in-plane forces and a curvature moment couple, 105, acting on the face at the boundaries of the actuator as is shown in FIG. 1. Some critical parameters are the spatial extent (length) of the actuation element as well as its thickness. The spatial x-y extent is determined by maximizing the coupling into a given desired face deformation shape. Good coupling can be equated to the integration of the transverse strain field times the electric field times the piezoelectric constants over the domain of the actuator. The coupling into some shapes and therefore some structural modes is maximized at corresponding actuator shapes and extents.

For example, for an axially symmetric plate with a circular actuation patch covering a given radius, coupling into the second axisymmetric plate mode (one nodal circle) is maximized when the extent of the actuation disk extends to that node radius but no further. If the disk had a radius larger than the nodal circle's, then material outside the circle would see strain of opposite sign to the material inside the circle and there would be a partial cancellation of the piezoelectric response when integrated over the entire disk.

For the particular case in which a transducer is coupled and it is desired to harvest energy from impact as well as potentially excite a high frequency mode (to control friction), the actuator must be designed in extent and thickness to achieve both: 1) coupling into the shape produced by the impacting ball (roughly the first mode deformation shape for center hits); and 2) coupling into the deformation shape associated with a high frequency mode.

Because faces are relatively thick structural elements, modeling suggests relatively thick piezoelectric elements on the order of 1 mm are required to produce significant actuation of the 2-3 mm face. Typical face designs have shown that a piezo element a few centimeters in diameter (1-5) can achieve the desired dual objective of coupling to both the energy generating first impact shape as well as a high frequency mode to be excited for friction control. A typical implementation of this type of face coupling is a 3-1 mode piezoelectric disk with electric field applied through its thickness and disk directly bonded to the face 10 (usually inside).

It is important to note that the piezoelectric element 21 can be prepackaged with polymer encapsulation and potential electrode patterns on such polymer or flex circuit. The patterns can define various active regions and produce segmented, uniform, or interdigitated electrode patterns in potentially curvilinear arrays. The key factor is to maximize electromechanical coupling (as defined above) between the piezoelectric and the face deformation.

Concept 2

The preferred method and system for coupling of an actuator or transducer to a face will now be described. In this method the actuation element 21 (preferably piezoelectric, but possibly electrostrictive or magnetostrictive or any of a number of actuation or transducer technologies described previously) is attached to the face though the use of a housing 12 or support structure attached to the face. A particular depiction is shown in FIG. 2*a* and in sectioned assembly in FIG. 2*b*.

In this case the actuation element 21 is configured to elongate or change size axially in response to input electrical energy (voltage or current). For a piezoelectric system this can be accomplished in a variety of ways. In particular, one can use a piezoelectric stack to couple applied voltage to length changes. This is known as 3-3 coupling and is a high mode of response of piezoelectric materials. A 3-3 stack is an arrangement of multiple piezo material layers with electrodes between the layers so that the electric field is aligned with a central axis to produce a longitudinal piezoelectric effect. This is shown in detail as subassembly 15 in FIG. 18. The actuator can also be configured as elongated transverse or 3-1 type actuator in which the field is applied perpendicularly to the axial direction. This can be achieved by a rod with electrodes along its length on opposite sides, or a tubular actuator with the load being applied along its length and the field being applied through the wall thickness by electrodes on the inner and outer walls of the tube. There are numerous other axially elongating actuator/transducer configurations known in the art.

The second element is a housing 12 which serves to mechanically connect the back end of the actuation element to the face. It serves as a stiff load return path coupling elongation of the actuation to deformation of the face Face deformation causes relative motion between the point (potentially at the face center) where the actuator makes contact and the point where the housing is attached to the face shown in FIG. 2*a* by the applied forces at these points 106. The stiff housing then translates that relative motion into relative motion between the two ends of the actuator. The housing 12 thus acts as a mechanical attachment which couples the actuator length changes to face differential motion (deformation). It is therefore in the elastic class of face couplings.

It is important that the housing be stiff (ideally rigid but at least on the order of the stiffness of the piezoelectric element), since any elongation of the housing under actuation loads will reduce the load transferred to the face and the resulting face deformation. To see this, one should consider the limiting case of a very flexible housing. Then, as the actuation element starts to elongate, the housing just stretches with it with little load and therefore little deformation is induced into the face. In reality, the condition generally is that the housing must be stiffer by at least 1 to 20 times greater than the face under an equal but opposite loading at the housing attachment and the actuator attachment in order to insure that the load is effectively coupled to face deformation rather than housing elongation. The housing should also be as light as possible to avoid adding a large mass and thereby significantly changing the center of gravity of the head or its inertia tensor.

Figure 17:
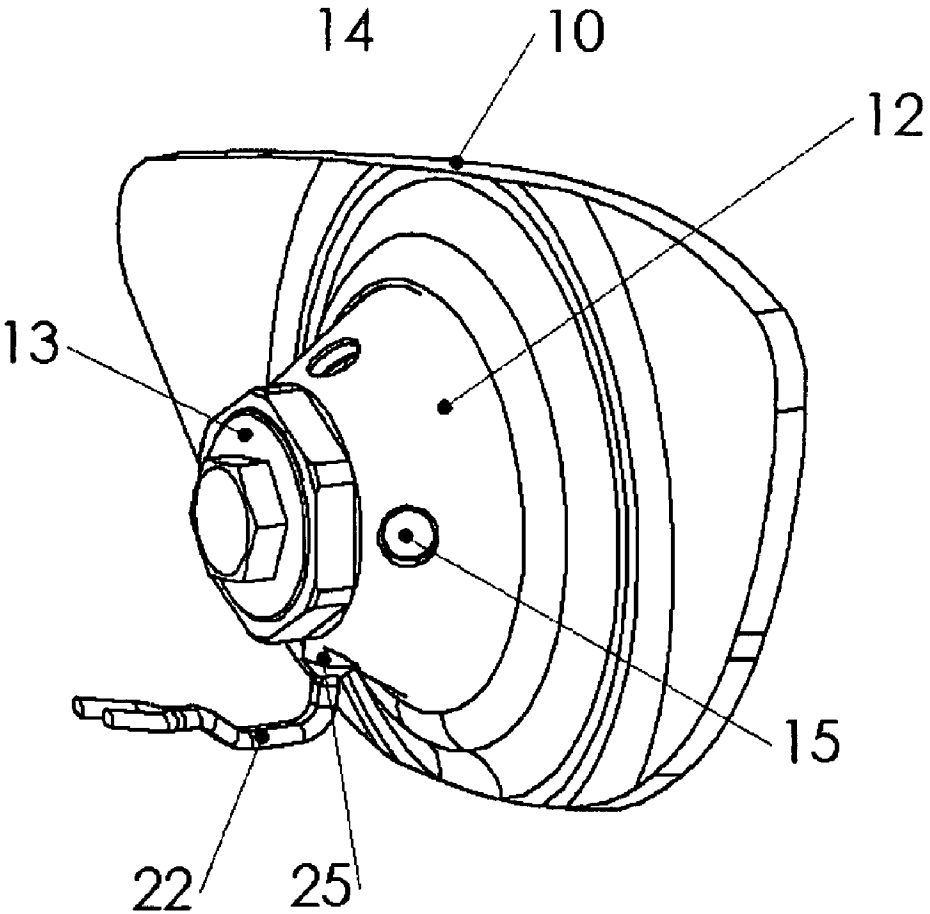
FIGS. 17-19 are detailed illustrations of the face assembly showing piezoelectric transducer to face coupling hardware for conceptual piezoelectric coupling embodiment of FIG. 2.
Figure 18:
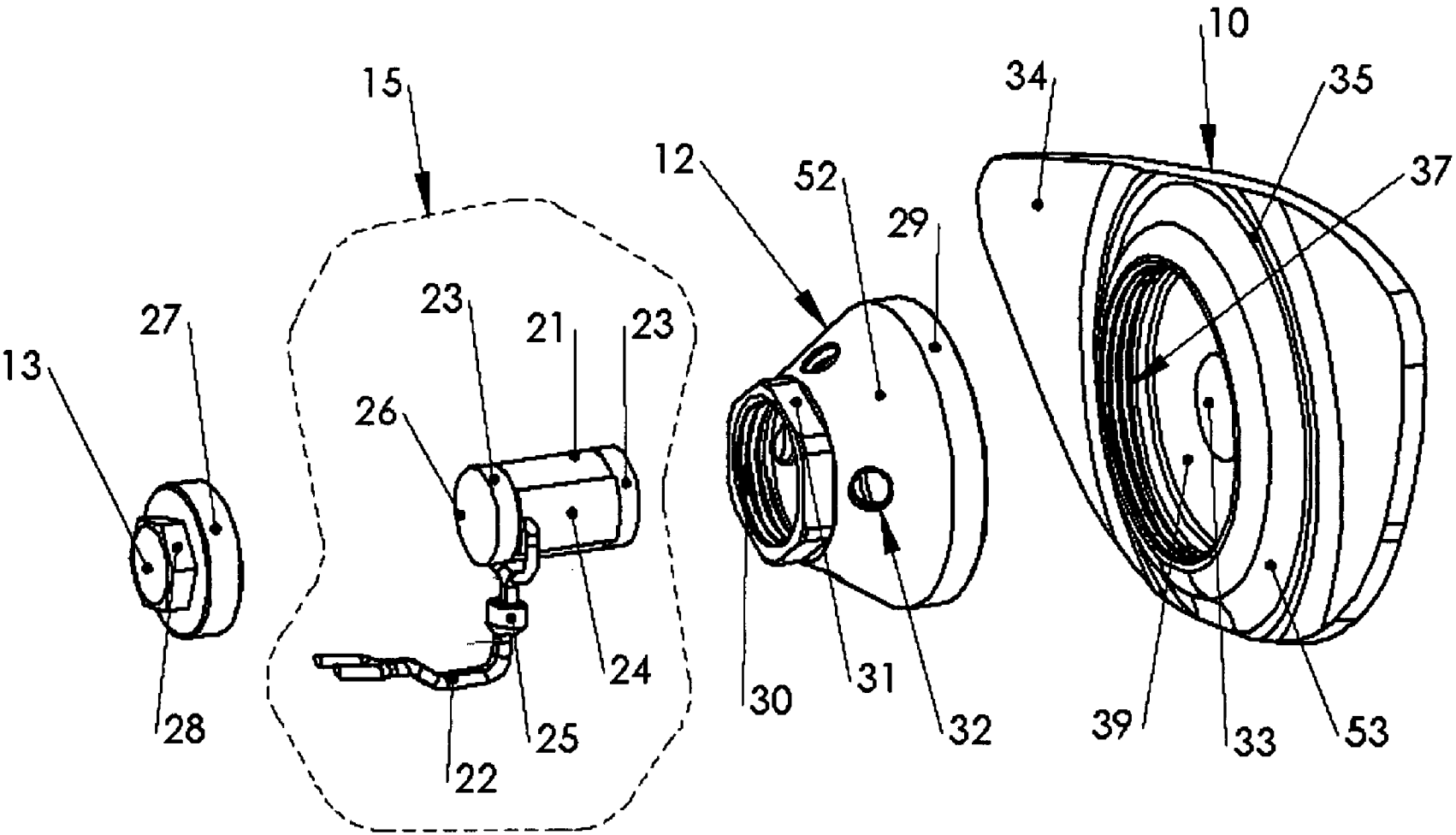

The housing 12 consists of a conical or cylindrical wall 52 with a back plate 13 that provides a contact with the actuator and a circular end which establishes contact with the face at a ring 56. See FIGS. 17-19 for detailed drawings of a preferred embodiment of Concept 2. The housing 12 can be screw attached 29, brazed or welded to the face, or use any of a number of other techniques. The end plate can be permanently attached, machined as one piece with the wall or configured as a screw part 13 for ease of actuator system assembly and removable for repair. It is important that all the compliances of the housing, including back face bending and other deformation of the housing, be taken into account when considering its stiffness under actuation loads. That is why a conical structure is very efficient, it reduces the bending of the back plate and provides a more direct load path to the face. Typical dimensions are ~1 mm for the housing wall 52 and ~3 mm for the housing back 13. The transducer assembly 15, consisting of piezoelectric layered actuator 21 and end pieces 23, is ~16 mm long (total) as shown in FIG. 18 (of which 10 mm is active material 21). The cross-section is a 7 mm×7 mm square stack or a preferred 9 mm diameter circular stack.

Of particular design importance is the selection of the contact point locations between the housing and the actuator and the face. If the actuator is arranged to make contact with the center of the face, the housing can be configured to attach to the face at a selected distance away from the center at either discrete points or a continuous (circular) ring at a fixed radius. Selection of this attachment radius is very important to maximize the performance requirements for a given control application. The end pieces 23 are preferably made of steel or alumina or other very stiff material and have some curvature 26 to provide a centered point contact with the face 33 and with the back of the housing 26 on nearly matching curvature (indentations).

In the particular case of friction control, an objective is to excite high frequency oscillations as described above. The diameter must be chosen to satisfy the need for: 1) good coupling to the impact deformation shape to generate electrical energy; and 2) good coupling to a high frequency mode. This can be accomplished by placing the attachment radius to correspond approximately to the radius of an anti-node of the face mode of interest. The anti-node should have preferentially opposite deformation direction at the center to maximize relative motion.

The design considerations in optimization are as follows—if the radius is too small, the piezo center force and the reaction force are imposed on the face very close together. The face is very stiff between these spaced points and little motion can be introduced. Conversely, the differential deformation between those attachment points under the impact deformation shape, is very small, since it determined by the curvature under impact loading, so little voltage is generated at impact. If the radius is made too large, then there is good coupling to the impact, but it becomes difficult to build a stiff housing structure and it becomes difficult to generate high amplitudes in a high frequency mode because of housing modes starting to participate, effectively lowering the dynamic stiffness of the housing. In the preferred embodiment, a diameter of attachment of approximately 35 mm was chosen for the face ring 56 as optimum for maximizing the dual objective of coupling to the ball impact face deformation and coupling into a high frequency face mode at ~120 kHz.

In evaluating particular designs it is necessary to take into consideration stresses in the face and housing and actuator during impact. Very high stress level can lead to low fatigue life of the housing. In addition, the high compressive stresses imposed on the actuator during ball impact can cause a permanent "depolarization" of the material, a permanent reduction in actuator properties. The mechanical system must be analyzed for its loads during a variety of ball impact events to determine that these critical load levels for life of the housing or stress induced depolarization of the piezoelectric element have not been exceeded.

One can either have the piezo at the center or one can use a bolt welded at the center of the face and use a piezo cylinder or multiple piezo-elements (for example stacks) radially spaced from the bolt as shown in FIG. 3. One can couple to the lowest impact deformation shape as well as high frequency mode shape in this configuration. Because of the axial arrangements relative to the face normal, it is easy to preload the transducer elements 21 for robustness using a centrally located face anchor 205 threaded to accept a preload bolt 206 and backing plate 212 and it's easy to design for desired surface excitation amplitude.

Concept 3

A third embodiment is shown in FIG. 4. In this embodiment the piezo 21 acts between the face 10 center and a stiff backing/support structure 207 . The support structure must be stiff for high reaction force—on order of 1-10× the stiffness of the face so that actuation induces deformation of the face instead of the backing structure. There is a potential to use an intermittent contact between the piezo and the face. Because of the requirements of high stiffness, the backing structure tends to be heavy as well.

In Concept 3 shown in FIG. 4, there is a piezo element 21 configured between the face 10 and backing structure 207 which then passes the face interface load to another piece of the club head, i.e. the rear, the body 11, or the perimeter around the face. When the face moves in about a millimeter during impact of the ball and therefore compresses the piezo, it generates a charge and electrical energy that can be used to power the system and for example excite an ultrasonic device. Because it generates electrical energy through relative motion and load between the face and backing structure, the design must have a stiff backing structure to resist the motion of the face and provide high piezo loading. If the backing structure were soft, it would deform with the face under low load and wouldn't actually squeeze or apply load to the piezo. This would imply poor piezoelectric electromechanical coupling to the impact.

This concept couples to axial motion (or normal motion) of the deformation of the face. That can be done by a single stack element or single piezoelectric monolithic element with a polling direction and the loading is basically aligned with the surface normal to the face. In this configuration the actuator would use the 3-3 mode of actuation. It could be a 1-3 mode actuator or it could be a tube with the electrodes on the inner or outer wall of the tube as described for Concept 2. The stress is therefore in the direction perpendicular to the polling direction. The basic reaction force is trying to inhibit motion of the face. The backing structure therefore needs to be stiff to accomplish this effect. This stiffness requirement can lead to relatively heavy structural elements which can by design be located relatively close to the CG. The added mass, however, would decrease the moment of inertia of the head for a fixed mass head since less mass would be available at the periphery.

In another embodiment of Concept 3, the piezoelectric element is initially not in contact with the backing structure. Upon ball impact, the deforming face would bring the piezoelectric into contact with the backing structure and load the piezoelectric element. The piezoelectric element for instance attaches to the face which is perhaps a half millimeter off from the backing structure. No contact is made until the ball hits. In this way the system can be designed so that only high amplitude impacts load the piezoelectric element and trigger the control function. Such impacting has been used to achieve damping in structural systems. It can also be used to change effective stiffness and the effective face reaction in different ball loading scenarios and therefore for different head speeds. For instance, if there is a small gap between the face and the backing structure, (even if there is no transducer there) low intensity impacts might leave the face unsupported, not forcing contact. For high intensity impacts, contact between the face and the backing will be established during impact; and the backing structure will support the face and reduce face deflection Concept 4—Shear Mode Piezo In the previous concepts the loading on the piezoelectric element has been primarily in the form of an applied normal stress. In Concept 4, the piezoelectric is loaded in shear and coupled into the electric field using the shear mode of piezoelectric operation. More information on shear mode and the major modes of operation of piezoelectric transducers can be found in the product literature for Piezo Systems Inc. of Cambridge, Mass. The shear mode piezoelectric element involves shear stresses about the axis of polarization in the material as shown in FIG. 5*a* For example, if the polarization is in the x direction in the material, the shear stresses would be in the x-z plane about the y axis as shown in FIG. 5*a*. In this mode of piezoelectric operation, the electric field, E, is applied perpendicular to the poling axis, x. This mode of piezoelectric response is sometimes called 1-5 mode of operation.

In Concept 4, the mechanism using a shear mode piezo actually works very much like a constrained layered damping treatment used commonly for damping of vibratory response of bending structures. The piezoelectric element 21 that is intended to be loaded in shear is located between the face and a stiff backing layer called the constraining layer 208. As the face bends under the impact loading as shown in FIG. 5*b*, the constraining layer resists that bending deformation putting the intermediate piezoelectric elements in shear. In Concept 4, one or multiple shear-mode piezo elements are located between the backing structure 208 and the face 10 as shown in FIG. 5*b* so that as the face bends, it induces a shear stress on the piezo which then can be coupled into the electrical field by the piezoelectric transducer. In the typical configuration the electrical field is aligned with the surface normal and the 1-5 mode piezoelectric elements are polarized in the plane of the face For instance one of the elements can be placed on each side of the plate at points of high curvature, then a bar or plate acting as the constraining layer is bonded between these piezoelectric elements. When the face deforms, the bar tries to keep it from deforming and that puts a large shear load on the piezos using the 1-5 mode of actuation.

In another embodiment, the shear mode piezoelectric element is a ring, polarized radially outward or inward. The ring can be bonded about the center of the face. The electric field would act through the thickness of the ring between the face and the constraining layer. In this embodiment, the constraining layer would be a disk with the same outer diameter as the ring bonded to the ring about its circumference. This is an axisymmetric version of the concepts presented above and acts to couple drumhead like face motion into the piezoelectric element.

The shear mode of operation is a very effective, very high coupling coefficient mode of operation for piezo transducers. Coupling coefficients for 3-3 mode of actuation and 1-5 mode of actuation are very similar. The coupling coefficient is defined loosely as the fraction of the mechanical energy input that is converted into electrical energy under a predefined loading cycle.

Concepts 1, 2, 3, and 4 are elastically coupled systems. The piezo is squeezed because of relative deformation between two parts of an elastic body. Since the face-piezo system is part of that elastic body, deformation of the face imparts deformation of the piezoelectric. For Concept 1 as the face (an elastic body) deforms, it deforms the piezo because it is bonded to the face. Concept 2 uses a support structure housing which connects to the face at a different place than the piezoelectric element (e.g., the piezoelectric element contacts the face at the center and the housing contacts the face in a ring at a defined radius out from the center). Because distinct contact points are established, relative motion effectively squeezes the piezo. In this manner the piezoelectric is coupled into the face motion. In Concept 3, motion of the deformation of the face squeezes the piezo attached between the face and the backing structure. In Concept 4, deformation of the face induces a shear stress in the piezoelectric element. All of these concepts rely on coupling into the elastic deformation of the face-body structure that represents the head of the golf club . For this reason these concepts are referred to collectively as having elastically coupled transducers.

Concepts 5, 6 and 7—Inertial Coupling Concepts

The next class, consisting of Concepts 5, 6 and 7, represents a different way of getting a load into the transducer that utilizes inertial forces during impact. These concepts utilize the load necessary to accelerate a mass to load a piezoelectric element. The piezo loading is thus a function of acceleration rather than relative deformation of the face. In the simplest embodiment, there is a reaction mass 209 (sometimes called a proof mass) and a piezo 21 is attached between that reaction mass and the face 10 as shown in FIG. 6. The system is analogous to a mass-spring system with the piezoelectric being the loaded spring. The moving face is analogous to a moving base in the spring-mass system. As the face moves under ball impact, inertial forces inhibit the motion of the reaction mass and the piezoelectric "spring" is loaded by the differential displacement between the face and the mass. As it is loaded, it generates the charge and voltage that can then be used to control the face as will be described hereinafter.

In these concepts it is important to tune the mass and piezo "spring" to couple well with the face motion during impact. In the scenario that the face moves slowly in comparison to the period of the first natural frequency of the spring-mass system, there is little relative motion between the face and the mass and therefore little piezo loading. In this scenario the mass follows the face well since elastic forces of the spring are much larger than the inertial resistance. In the alternate scenario, if the face moves very quickly, the mass can't respond and the piezoelectric "spring" is squeezed by the amount that the wall moves. Thus the load that the piezo sees and therefore the amount of coupling to face motion depends on the relative mass and spring constant of the system and the timescale of the forcing.

To illustrate the system behavior, consider the case when the face is moved with a ½ sine wave similar to an impact motion, the center of the face moves a distance inward (about 1 mm)under ball loading and comes back to normal position in a certain period of time known as the impact duration. If the impact event takes a ½ millisecond ,it would correspond to an input wave form corresponding to one half the cycle of a one kHz input. If the piezo 21, the mass 209 and the spring (face 10) have a natural frequency which is significantly greater than that one kHz, that system looks like a rigid body under that base (face) motion. In this scenario, there is not a lot of relative deformation in the piezo. The relative motion corresponds to the amount of strain the piezo sees and thus the voltage the piezo sees in open circuit. With this as the metric, the achievable open circuit voltage under impact drops off to zero at very low frequency inputs (long duration impacts and stiff piezo-mass systems). It rises up to a resonant peak when the input is commensurate with the time constant of the spring mass system with the face held rigid. If the first fundamental mode of the spring mass system is below the forcing frequency, then as the face moves the piezo gets squeezed by an amount of the relative deformation between the moving face and the inertial mass. This is because the mass in unable to move fast enough to respond to the relatively high frequency face motion.

A typical 1 cm by 1 cm by 1 cm cube piezo with a typical 10 gram mass on the end, might have a frequency in the 20-40 kHz range. That would be too stiff to couple well into that ~1 kHz face motion unless a very large reaction mass is used. So what that implies then is that the designer must try to create a system where there is smaller mass and much smaller effective piezo element stiffness, supporting that mass. If well designed, the mass-piezo natural frequency is commensurate and thus well coupled into that ball impact.

To achieve this frequency tuning, the designer must soften the piezo element by either making it thinner or using some mechanism to make it effectively have a lower spring constant. Concepts 6 and 7 shown in FIGS. 7 and 8 respectively demonstrate some manifestations of this using mechanically amplified piezoelectric transducer configurations. These concepts act by lowering the effective spring constant of the piezo element, lower than for a stack element. Stack elements can be very stiff. The mechanical amplification increases piezoelectric transducer stroke while lowering its blocked force, essentially reducing the effective stiffness of the transducer, lowering the spring stiffness between proof mass or the reaction mass and the wall of the face.

If the surface of the face moves slowly relative to the natural vibration of the effective piezo spring and mass system, then there is relatively little deformation of the piezo and little charge buildup. If it moves fast relative to the time constant, then the piezo element is squeezed by about the deflection of the face. To get energy into the piezoelectric transducer, the question is how you design the spring and how large the mass has to be? If the spring and the mass have a natural frequency that's tuned to the time constant of the face motion, for instance a time constant of a ½ ms, then you want the natural frequency of that spring mass system to be about 1 kHz, and then loading in the piezoelectric element is maximized. At high frequency, the mass looks like more of an inertial reaction mass. The piezoelectric element pushes off from that reaction mass. This allows excitation of direct surface motion in the face by force between the reaction mass 209 and the face 10.

Concept 5 has the obvious problem of the piezo tied directly to a mass which ends up being a very stiff system, requiring a large mass to get the natural frequency down to the range best suited for ball impact coupling. There are numerous techniques for lowering the stiffness of the piezoelectric by mechanical design. For example, piezo rods consisting of very thin small diameter pillars can be embedded in an epoxy to lower the effective stiffness but keep the piezo charge coefficients in place. That's called a 1-3 piezo composite. A composite also works well with a particulate composite using a piezoelectric particulate in epoxy. By selecting the appropriate particulate volume fraction a transducer can be designed to lower the effective material stiffness. Other ways of lowering the effective piezo spring constant without sacrificing coupling coefficient are other configurations of the piezo system, such as having the piezo element mechanically amplified. Concept 6 shown in FIG. 7 illustrates the general idea of a mechanical amplifier 210 to lower the effective stiffness of the amplified piezoelectric. There are thousands of different types of mechanical amplifiers that take very large force and very small stroke piezo motion and turn it into much larger stroke, but lower force output. Basically, the effective coupling coefficient of the mechanically amplified piezo is always lower than the effective coupling coefficient of the piezo by itself. Concept 6 represents an approach which uses a concept called aflex-tensional piezo. In that scenario, axial deformation of the motion amplifier (in the directing perpendicular to the face) creates horizontal motion and deformation of the piezo. As the piezo changes size side to side, (i.e., as the piezo gets longer, shorter), it pushes or pulls between the reaction mass and the face. Amplification ratios may be anywhere from a factor of 2 to 100. Very small motion creates a very large motion of the system. A mechanically amplified piezo actuator produces higher stroke and lower force output. Therefore a softer spring can be used between the face and the action mass to lower the needed reaction mass, lower than required if you had a piezo without mechanical amplification.

Concept 7 shown in FIG. 8 is a bender configuration. One possible manifestation of the bimorph bender 211 is a rectangular strip with one central layer of shim and 2 layers of piezo on either side. Sometimes there is no shim, just 2 layers of piezo. The piezos are actuated so that the top expands and the bottom contracts. That causes a bending of the element very similar to bending of a bimetallic strip due to different coefficients of thermal expansion of the top and bottom layers. The output of this device 211 is force and deflection of the tips. It's a bending mode actuator that essentially turns a small piezo motion in the plane of the bi-morph into large tip deflection out-of-plane. It works in a manner similar to the mechanical amplifier. Typically, the bi-morphs have much larger tip deflection than in the axial stroke piezo. Basically the tip deflection of the beam that represents the bi-morph bender turns into the axial compression or tension on the piezoelectric element. Those are typically 1-3 mode elements where there is a piezo wafer with electrodes and loading in the plane of the bending element. Some have used piezo fiber composite (PFC) actuators for the bimoph piezoelectric layers. These PFCs can be configured to put the electric fields in the plane of the system using inter-digitated electrodes and the fibers in the plane of the system to couple to the planar fields. Two piezo fiber composites can be attached (bonded or laminated) onto each other and can be configured as a bimorph bender. It's an element with high coupling coefficient but has much better force deflection characteristics. In this concept, the bi-morph is typically situated between the proof mass 209 and the face structure 10.

FIG. 8 shows the single bi-morph in a proof mass off to the side. You could have two on opposite sides. Bi-morph transducers have properties making them efficient as electromechanical transducers. Instead of having a beam pure rectangular plane form so the beam is constant width, the width and/or thickness of the bimorph can be changed as a function of the length along the beam. It actually is advantageous to taper the bimorph so that it's wider at the base and reduces down to a much narrower platform at the point where the load is applied. This works as a more efficiently coupled system to tip motion. Also it's advantageous to change the thickness of the beam as a function of it's position along the length of the bi-morph. It is best to have the thicker beam at the root and thinner beam at the outside. That maximizes the stress in the device and minimizes the mass of the device necessary to achieve a stated level of energy coupling. You equalize the stress level of the piezo so you don't have one highly loaded section of the piezo and one very lightly loaded section. Relatively uniform loading increases its effective coupling coefficient.

The bi-morphs don't have to be rectangular elements. They could be tapered or round. They could have variable thickness. They have also been fabricated as curved structures. There are many different configurations for piezo bi-morphs.

Of particular note is the possibility of a disk shaped (round) bimoph configuration. The piezoelectric bimorph disc is attached at the center of the disk to the face with a standoff. The proof mass is a ring attached at the outer radius of the piezoelectric bimorph. The electrodes on the bimorph can be axis-symmetric and uniform or sectored circumferentially (pie piece shaped sectors) so that differential tilt can be actuated/responded to by the piezoelectric element.

The Concept 5 embodiment is shown in FIG. 6. The piezo 21 acts between the face center 10 and a reaction mass 209 sized such that a first natural frequency of the mass on the piezo is commensurate with twice the impact duration (tuned). This implies a need for amplified or less stiff piezo if little reaction mass is used. It is a challenge to make the piezo soft enough to accept high impact energy but stiff enough to impact high force at high frequency. A heavy reaction mass may be required.

The Concept 6 embodiment is shown in FIG. 7. This is like Concept 5 except one substitutes a mechanically amplified 210 piezoelectric actuator. A motion amplifier 210 converts small piezo motion to larger relative motion between the face center and the reaction mass. One may solve an impedance miss-match problem but there is a potentially heavier and more complex mechanism.

The Concept 7 embodiment is shown in FIG. 8. A bimorph bender 211 acts between a mass 209 and the center of the face 10. It's like Concepts 5 and 6 but uses a bimorph piezo between the face and a mass. It can use an axisymmetric bimorph disk and ring mass. It can use multiple rectangular or triangular shaped bimorphs and masses. One must tune the first mass natural frequency to the impact event and then segment electrodes to help locate the ball impact on the face. There's an indeterminate high frequency force output.

Concept 8—Actuator Coupled between Face and Body

The Concept 8 embodiment is shown in FIG. 9. In this embodiment the actuator or transducer 21 with electrical leads 22 is disposed between the body of the club 11 and the face 10. In this manner, loads between the face and the body at impact can be converted into electrical energy by the transducer during impact and the face can be positioned relative to the body during impact by selective controlled actuation of the transducer element(s). These actuations can be used to change the position such as rotation of the face relative to the body to counteract the rotation induced in the system by eccentric impacts.

There are multiple modes of operations possible with this configuration of the system. The first is quasi-static positioning. In this mode of operation, the face is repositioned from its initial orientation to an alternate position relative to the body and ball. For instance, the face angle is adjusted slightly in off-center impact events. The angle adjustment is pre-calibrated to achieve a reduction in miss distance—for instance compensating for a hook or slice by re-pointing the face. The benefit is accrued by changing the static (with respect to the impact event) positioning of the face.

In an alternate mode of operation, the face is repositioned during the impact event so that the induced motion itself causes a desirable effect on the impact outcome. For instance, the face can be moved tangentially (perpendicular to the face normal) such that the face tangential velocity during impact beneficially effects the ball spin through the frictional interface between the ball and the now tangentially moving surface. The face can be forced to have a tangential velocity which has the effect of reducing or increasing the ball spin resulting from the impact event. This spin control can have desirable effects on the subsequent ball flight or ball bounce and roll behavior after it hits the ground.

In a particular example, the face can be moved upward tangentially to the face normal axis during the impact event. This can be controlled to occur only in high impact events that would otherwise produce too high a spin during impact. That too high spin can result in excess lift and decreased flight distance as is known in the art. The velocity of the upward motion can be a fraction of the ball tangential velocity in this same coordinate frame. In this case there will be less relative motion between the ball surface and the face surface resulting in less spin up of the ball during impact and therefore more distance during flight.

The Currently Preferred Embodiment (Concept 2)

Principle of Operation

As the ultimate design goal, the head is designed to convert impact energy into high frequency, high amplitude vibrations of the club face. High frequency excitation of the face reduces face/ball effective friction coefficient using the techniques disclosed in the Katoh and Adachi references and known in the art. The reduction in the effective ball/face friction coefficient during the face oscillation, acts to reduce ball spin induced by frictional contact with the face at impact. Simulations of ball flight have shown that reduced ball spin resulting from impact leads to increased ball travel in a high effective ball velocity scenario. These scenarios are those associated with high effective ball velocities i.e.—high head speed and/or high headwind. In these conditions the excess lift caused by high spin on the ball results in a ballooning trajectory which results in a considerable reduction in down range trajectory. Studies have shown that a 25% reduction in ball spin can increase down range flight distance by 10-20 yards in some high relative velocity scenarios.

Reduced friction between the ball and the face can also result in reduced sidespin on the ball resulting from impact. Reduced ball sidespin leads to reduced cross range scatter and increased accuracy in the drive. It is therefore the intention of the invention to provide a system that can impart the requisite surface oscillations on the clubface so as to achieve the known desirable benefits of controlled spin reduction. The system is controlled in the sense that only the high velocity impacts (those which exhibit the undesirable excess spin) will trigger the spin reducing oscillations. It is furthermore the intention of the invention to power this controlled friction reduction system entirely from the energy available at impact between the golf club head and the ball thereby requiring no external power supply such as a battery.

Figure 12:
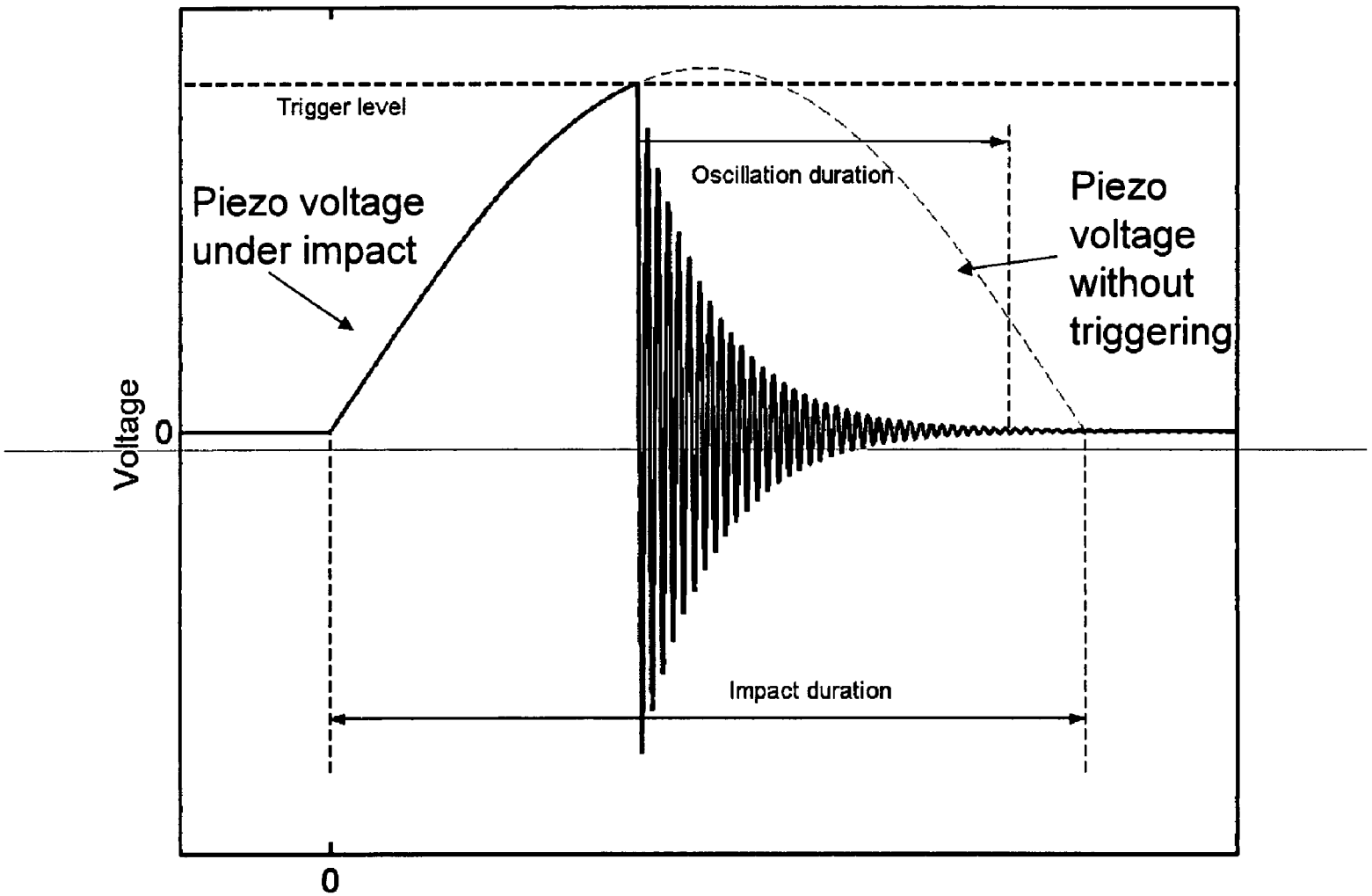
FIG. 12 is a graphical presentation of an actuator output voltage signal under ball impact showing un-triggered and triggered voltage time histories.
Figure 13:
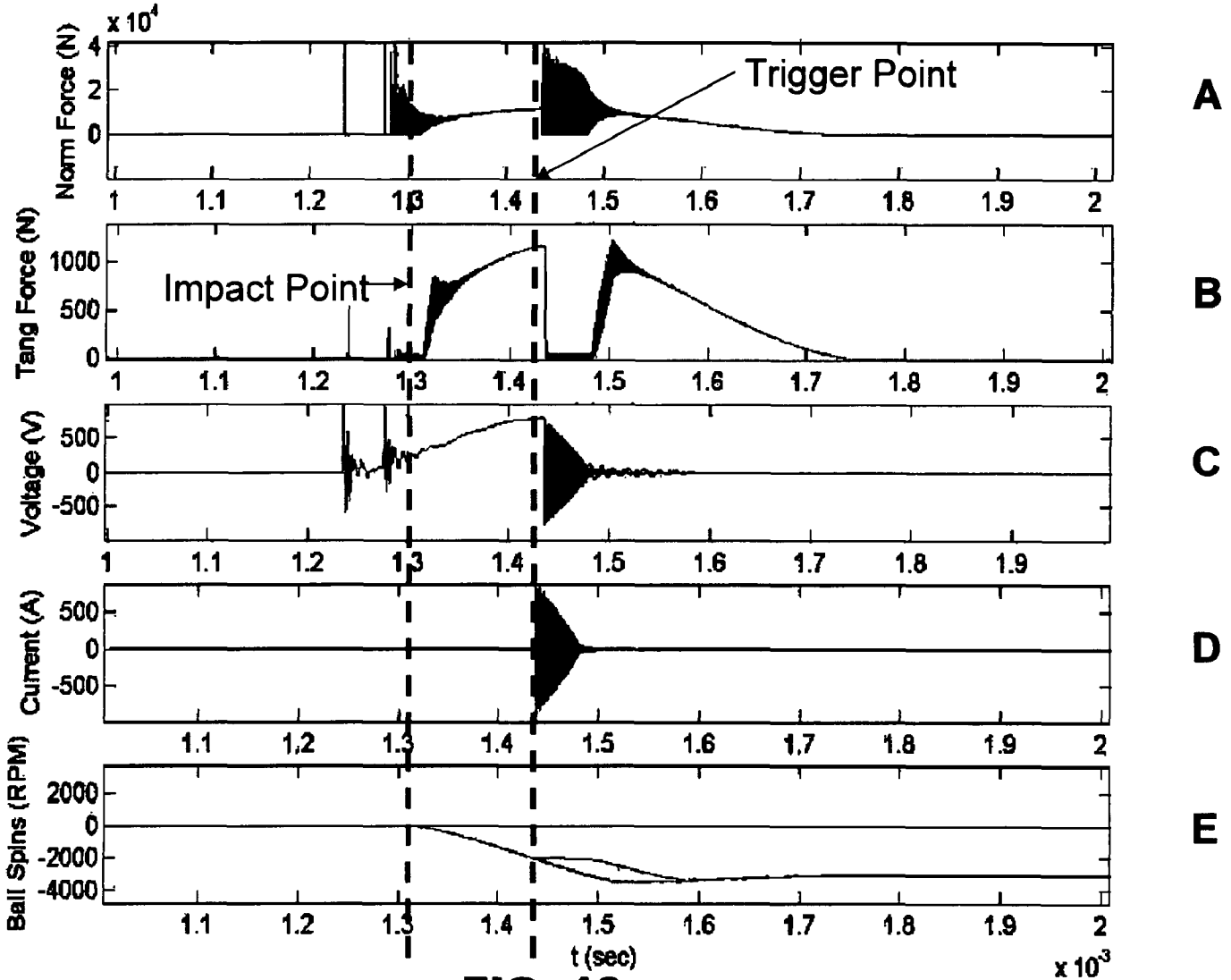
FIG. 13 is a graphical presentation of the time histories of key parameters in the ball to club impact showing A) impact normal force, B) impact tangential (friction) force, C) transducer voltage time histories, D) transducer current time histories, and E) resulting ball spin time histories.

Simulations indicate the ability of a high frequency driven club face oscillating with a 5-10 micron amplitude near or above 120 kHz to dramatically lower ball spin rate. Simulations of a ball—club impact are shown in FIGS. 12 and 13. FIG. 12 shows the voltage time history of a piezoelectric transducer coupled to the face during impact. The voltage rises until it reaches a critical trigger level (set in the electronics) at which point an oscillation is excited which is tuned to the face mode of interest (120 Kz). These high frequency oscillations are shown in FIG. 13 to reduce the friction coefficient and tangential force between the ball and the face—thereby reducing the rate of spin up at impact and the resulting ball spin. Curve C in FIG. 13 shows the voltage time history analogous to that shown in FIG. 12. FIG. 13B shows the tangential (friction) force between the ball and the face indicating the reduction afforded by the high frequency oscillation in C. The ball spin rate is shown in 13E wherein the ball spin does not increase during the time that the tangential force is reduced due to the oscillations of the face. The effect is predicated on the hitting surface reaching a critical peak acceleration during the oscillation cycle. The critical parameter for friction reduction is that the hitting surface (clubface) has to intermittently break contact with the impacting ball. For that to happen in a ball-face impact scenario, the acceleration of the face away from the ball has to be large enough to break that contact. In effect, the face must move out from under the ball. This only needs to happen for a short fraction of the impact event in order to effect the ball-face friction as shown in FIG. 13. Since during the ball-face impact there is a high preload, there is a high compressive load between the ball and the head, shown in FIG. 13A. This ball-face normal load causes the ball to accelerate in the direction of the eventual ball flight. The ball is initially at rest and then it has to undergo a high acceleration rate to reach its peak velocity after the impact event. In order to break contact, the face must accelerate at a level on the order of this ball acceleration for at least a portion of the cycle.

The face has to reach a sufficient acceleration backwards away from the ball in order to break contact. The amplitude of oscillatory motion of the face times the frequency of that oscillatory motion squared is proportional to the peak surface acceleration. It has been found that surface oscillatory motions in the range of 5-20 microns amplitude at frequencies in the 50-120+ KHz range have sufficient surface acceleration to break the contact between the face and the ball in a wide range of impact conditions. Lower surface motion amplitudes are needed if the oscillation occurs at higher frequency (all else being equal)

When this occurs, the face moves back away from the ball at very high acceleration rates for very brief periods of time. The principle of operation is that the induced surface motion has a great enough amplitude and frequency and the surface acceleration will be high enough to overcome the compressive loading due to ball impact and actually break contact between the ball and face. The face actually moves away from the ball surface faster than the ball can respond to the lowering of interface force. It moves out from underneath the ball.

Figure 20:
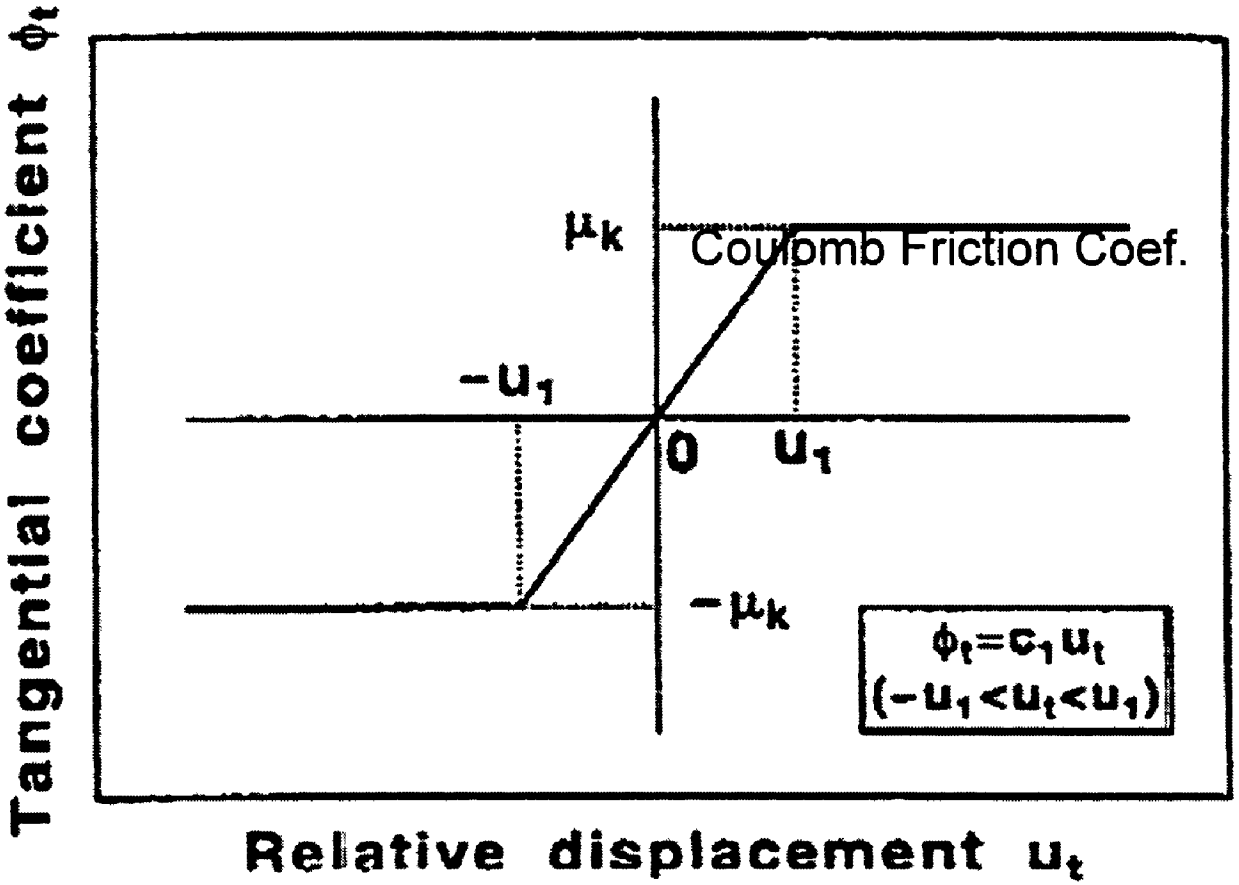
FIG. 20 is a graphical presentation of the friction model for the interaction between the face and the ball.

The breaking of contact resets the micro-slip region used in a common model of interfacial friction. In this friction model (Katoh) shown in FIG. 20, there is a small amount of relative tangential motion, u, allowed between the bodies (surfaces) before the friction forces build up to the levels associated with Coulomb (sliding) friction. FIG. 20 which is a plot of effective friction coefficient (tangential coefficient), $\phi_t$, as a function of relative displacement between the bodies u. This region of lowering frictional coefficient is due to tangential elasticity at the interface. As the surfaces slide past each other, the friction grows rapidly (in the course of a few microns travel, noted by $u_1$ in FIG. 20) up to the asymptotic level associated with the Coulomb friction between two sliding surfaces. This friction model represents micro-deformation that occurs to accommodate the relative motion between the surfaces before the interfaces begin to slip. This interface model is presented in the Adachi reference.

By breaking contact between the ball and face repetitively before the objects have had enough relative motion to be in the asymptotic region, the sliding between the surfaces occurs only in the micro-slip region which has much lower effective coefficient of friction. Over multiple cycles of breaking contact, the sliding motion is therefore integrated to a lower average friction coefficient between the ball and the face.

There are number of dynamic interactions which occur during the ball-face impact. The forces can be thought of as active normal to the face and tangential to the face. Normal forces act through the center of mass of the ball and so to first order accelerate the ball and do not directly induce spin. The tangential forces that arise from the friction between the ball and the face act both to affect the tangential component of velocity as well as the ball spin.

In the tangential direction during the course of the impact event, the ball is starting a slide up the face as it starts to roll. By the time it leaves the face it's usually rolling up the face with little sliding component, i.e. the ball is rolling (spinning) at a rate such that the point of contact at the surface of the ball and the face is not moving relative to the face contact point. By controlling the effective coefficient of friction between the ball and the face, the degree to which the ball spins up during impact is controlled as shown in FIG. 13 trace E If the friction is reduced enough, the tangential forces will not be sufficient to spin up the ball to the point of pure rolling. Therefore since the tangential (friction) forces directly effect the ball spin, controlling these forces can lead to ball spin control.

System Implementation

Figure 10:
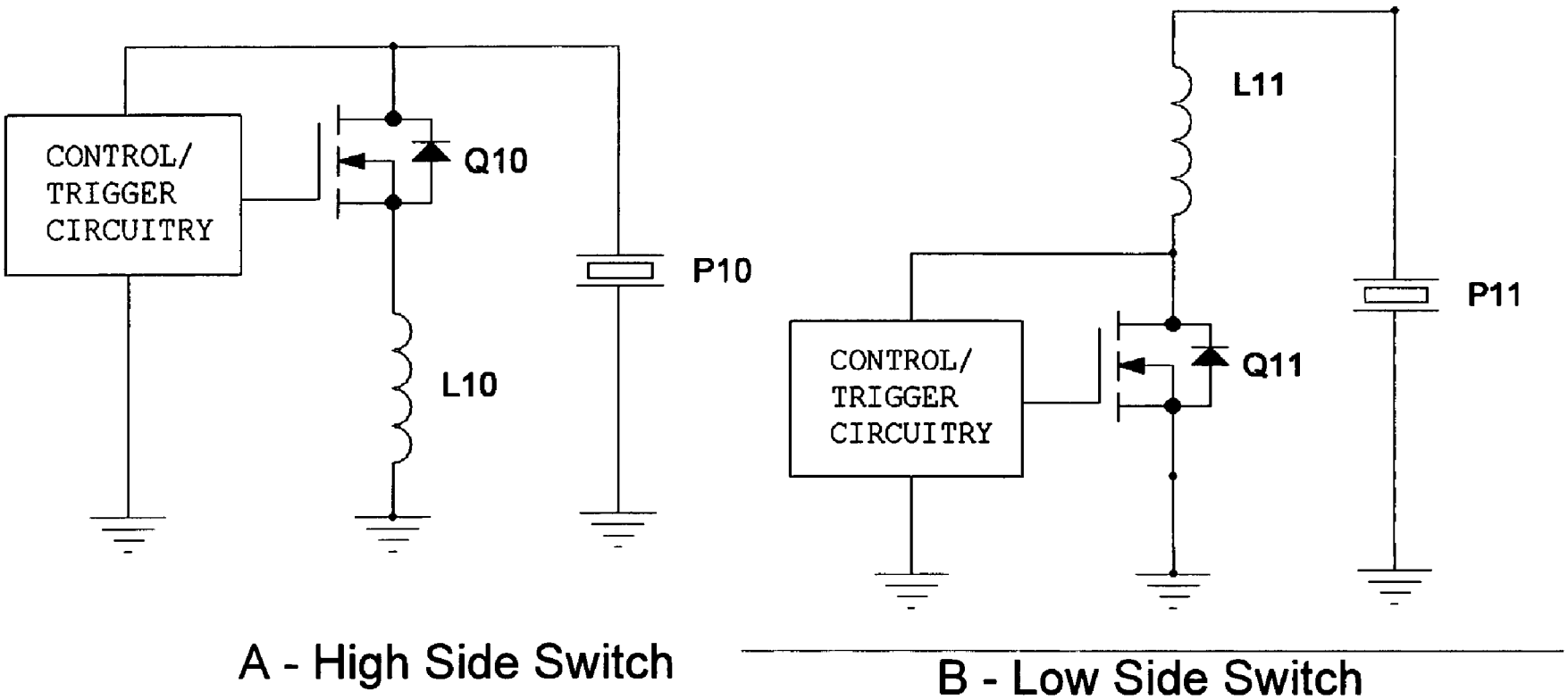
FIGS. 10*a* and 10*b* are a block diagrams of a piezo actuator with controlled switch, inductor, and control circuit.

The system is designed to capture the energy from the ball club head collision and use it to excite high frequency (ultrasonic) vibrations of the face, using these to control friction between the face and ball as described above. It is implemented using piezoelectric elements elastically coupled to face deformations. In the preferred embodiment the same piezo transducer (in the most general sense as defined for piezo above) is used both to extract energy from the impact for powering the system as well as using the extracted energy to excite ultrasonic vibrations in the club face. In operation, the impact deforms the club face onto which the piezoelectric transducer is elastically coupled such that face deformations are converted to electrical energy (charge and voltage on the piezoelectric element) for example the elements P10 or P11 in FIG. 10. The electronics that are coupled to the piezoelectric transducer are configured such that the piezo is initially in the open circuit condition while it is charging up during the impact. At some point the piezoelectric voltage reaches a critical level (trigger level) pre-defined in the system at which point a switch Q10 or Q11 in FIG. 10 is closed thereby connecting an inductor L10 or L11 across the piezoelectric electrodes. The inductor is configured such that the resulting LRC circuit (the C being the capacitance of the piezoelectric element, and the L being the shunt inductor) responds in an oscillation (ring down) that initiates upon connection of the inductor circuit across the piezo electrodes. The component values are selected such that the frequency of the ring down is approximately tuned (as described below) to a high frequency dynamic structural mode of the face/piezo system such as the mode highlighted in the frequency response function in FIG. 22—thereby causing high frequency face motion/oscillation by virtue of the piezo electro-mechanical coupling. The system is designed such that the high frequency face motion is sufficient to control the friction between the ball and the face as described above.

The system has a number of design issues that will now be discussed. The system is designed to maximally charge up the piezo to obtain maximum electrical energy stored in the piezo capacitance prior to initiation of the ring down/oscillation. This maximizes the oscillation amplitude. In addition the system is designed structurally and electrically so as to maximize the coupling of the piezoelectric to high frequency face motion as will be described below.

Figure 11:
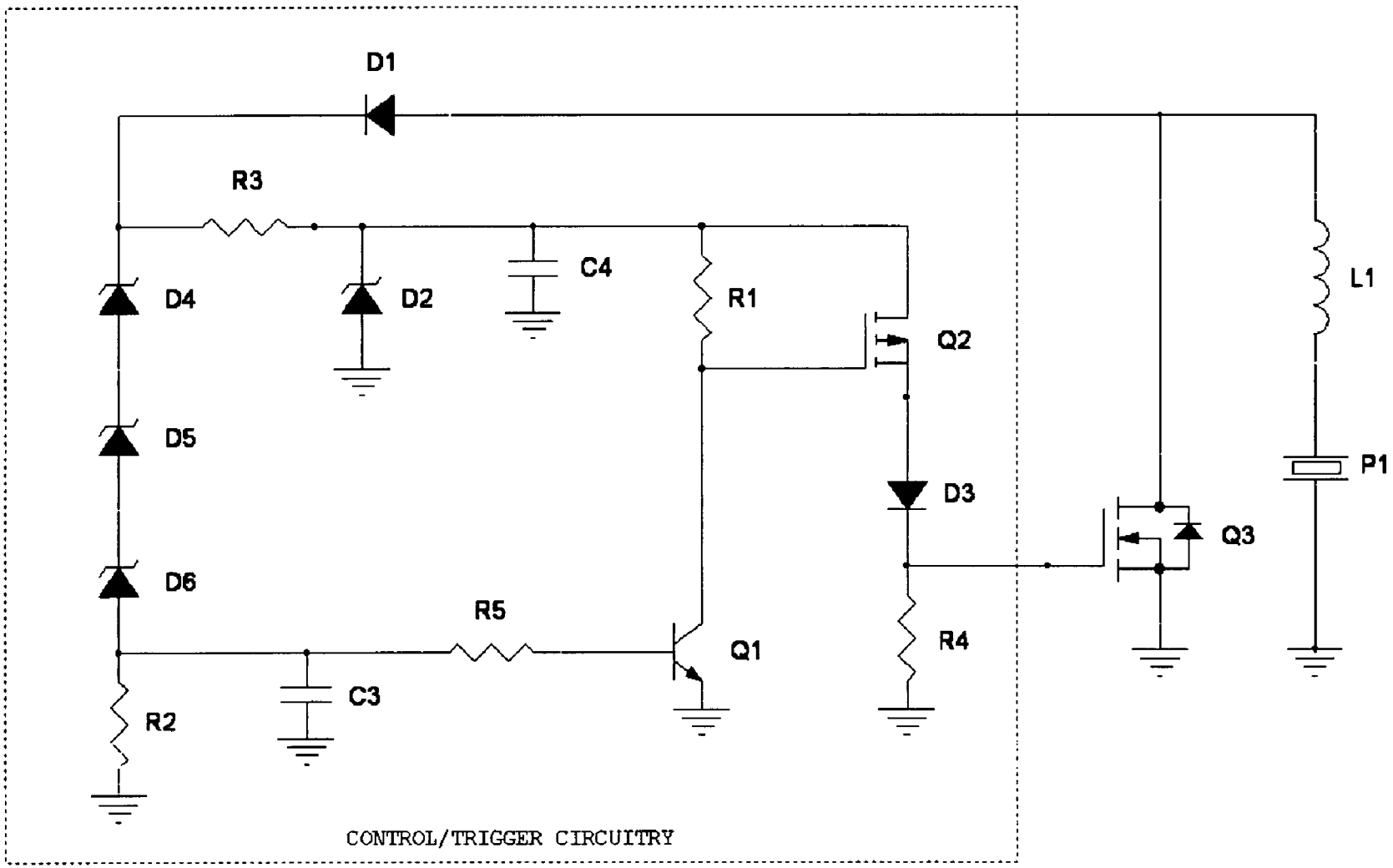
FIG. 11 is a schematic diagram of the circuit of FIG. 10*b* showing the control circuit in more detail.

Piezoelectric element (21) shown in FIGS. 2*a* and 2*b* is elastically coupled to high frequency face mode so as to excite high frequency vibrations. The electrical circuit is designed to harvest the impact electrical energy and use it to drive an oscillator approximately tuned to the selected the face modal frequency. The electronics convert a small portion of the impact energy into high frequency oscillations of the clubface. As the piezo charges up, when it reaches a threshold (trigger level), the control switch (Q10 and Q11 in FIG. 10 and Q3 in FIG. 11 is turned on shunting an inductor across the previously open circuit piezoelectric and initiating a high frequency oscillation at the frequency determined by the inductor and piezoelectric capacitance as illustrated in FIG. 12.

The frequency is determined by an LC time constant. The inductor is sized for high frequency resonance and should have very low resistance to reduce energy loss, and appropriate magnetic core or air core to reduce magnetic hysteresis loss and magnetic field saturation effects. The switch can most easily be implemented with MOSFET transistors although other switches with the characteristics of potentially rapid turn on time (sub 1 microsecond) and low resistance when closed. There are many other desirable characteristics of the switch which will be discussed hereinafter.

Face and Piezoelectric Design

Figure 21:
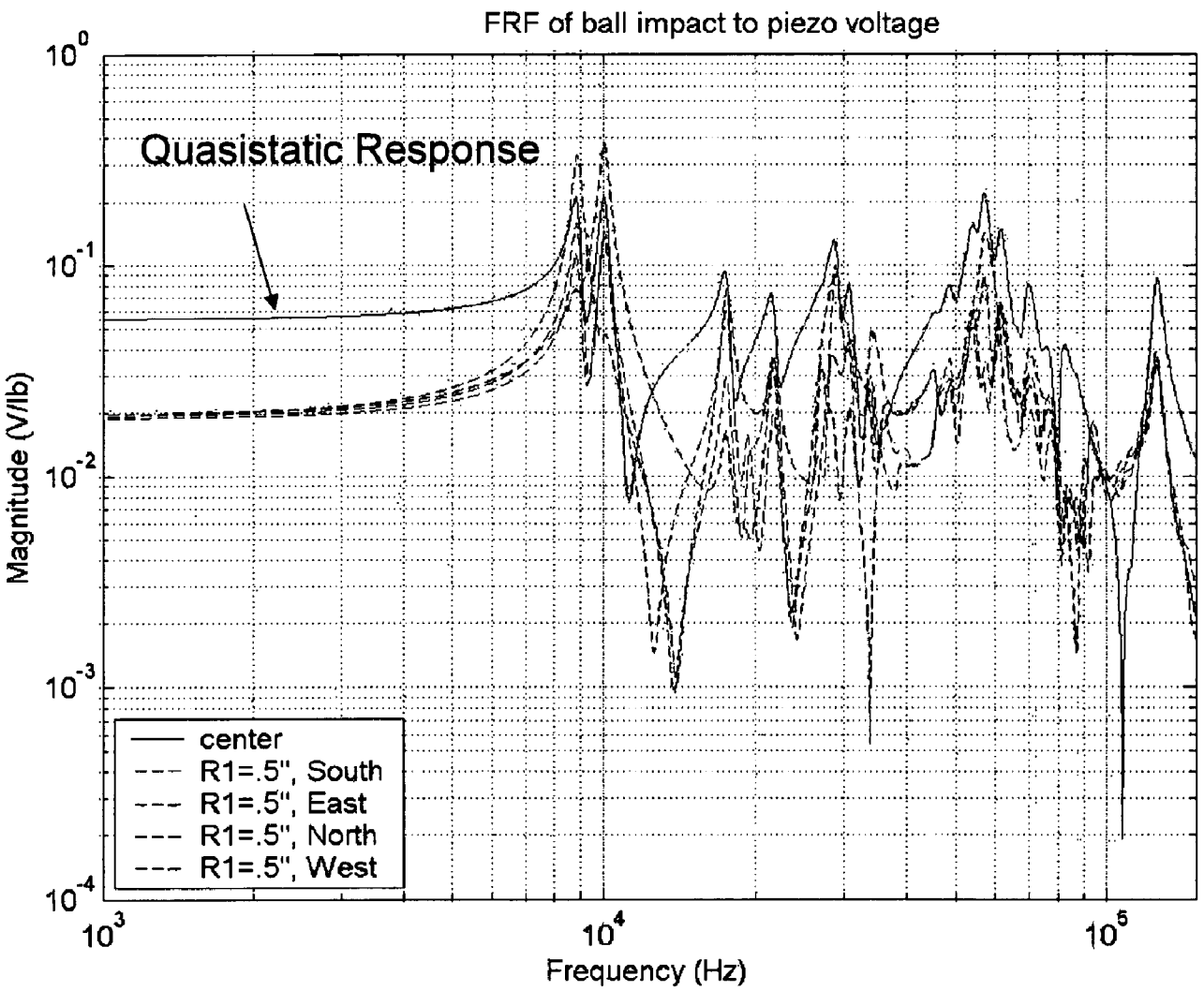
FIG. 21 is a frequency response function showing the voltage response of an open circuit piezoelectric transducer undergoing periodic loading on the face of the club.

The piezoelectric transducer is coupled to the face motion such that deformation of the face results in piezoelectric voltages and charges. The objective of the design is to maximally couple the piezoelectric transducer simultaneously to achieve two effects: 1) maximum coupling (and resulting voltages) to face deformations resulting from ball impact on the face.—both impacts at the center of the face as well as impacts off center, and 2) maximum coupling to a high frequency mode of oscillation of the coupled piezo-face structural system. The coupling from face loading to the piezoelectric open circuit (OC) voltage is represented in FIG. 21 which shows the transfer function from a distributed loading representing a ball impact to the piezoelectric open circuit voltage. The curve represents the response to center hits and there is a different curve for each hit location located 0.5 in from the center location in each of the squared directions (above=north, below=south, toe-ward=west, heel-ward=east). The quasi-static open circuit voltage for a 10,000 N loading proportional to a 95 MPH head swing is represented by the lower frequency asymptote of the transfer function noted in FIG. 21. This figure of merit (FOM) can be averaged over a series of hit locations to yield a design FOM that attempts to maximize the piezoelectric voltage that is generated by a range of center and off center hits.

Figure 22:
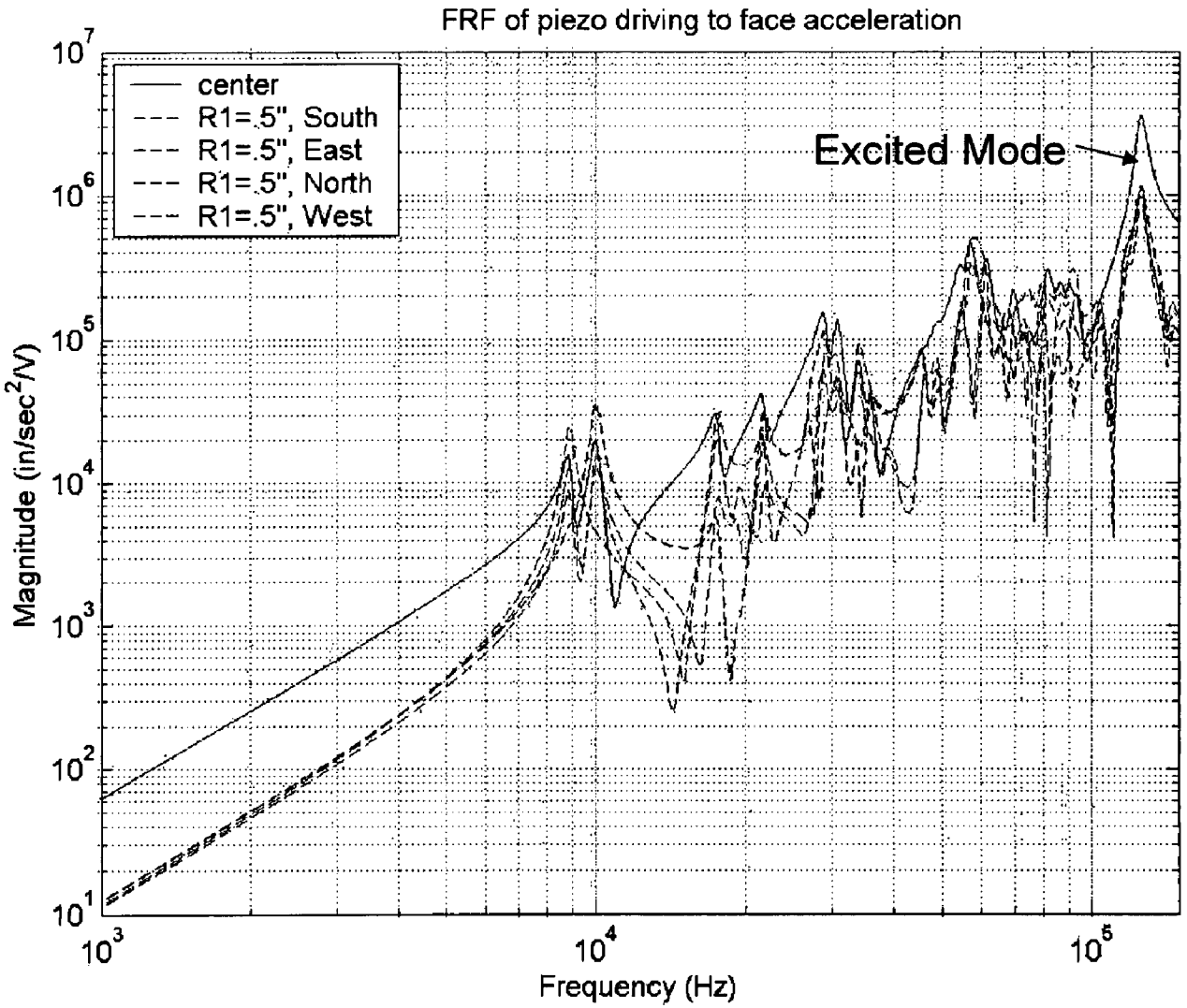
FIG. 22 is a frequency response function showing the face surface acceleration as a function of the amplitude of time varying voltage excitation of the piezoelectric transducer.

The coupling to high frequency face mechanical oscillations is represented by the transfer function in FIG. 22. This figure represents the transfer function from applied sinusoidal piezoelectric voltage to face surface acceleration at the center of the face (and at points 0.5 inches away in each of the before noted directions). In a like manner to the voltage response transfer function mentioned above in FIG. 22, the motion/acceleration at a range of locations can be used as the figure of merit for the design—averaged or weighted. As is seen, the high frequency acceleration response is maximized at a vibration mode of the face and coupled piezoelectric system ("Excited mode" in FIG. 22). In the preferred embodiment this mode occurs at 127 KHz. Driving the face at this frequency will maximize surface acceleration. In a like manner, a ring down of the piezoelectric oscillating in the range of frequencies associated with the high acceleration response will lead to maximal surface acceleration.

The goal in the design is to maximize both achieved open circuit voltage due to center and off-center hits as well as to maximize surface acceleration during the subsequent ring down response from this voltage after the circuit has been triggered. The geometry of the system is selected to maximize these two figures of merit resulting in maximal high frequency response of the surface due to the system activation.

The piezoelectric element, club face, and conical housing elements described below are all configured such that the resulting coupled system exhibits these qualities. It is a coupled system design since the surface response to impacts and resulting voltages are a function of the housing, piezoelectric transducer, as well as the face geometry and material. In addition, the high frequency mode shapes and frequencies are very much a function of all three elements of the design. In the following sections, the piezoelectric transducer will be described followed by the housing and face structures.

Stack and End cap Design

Figure 19:
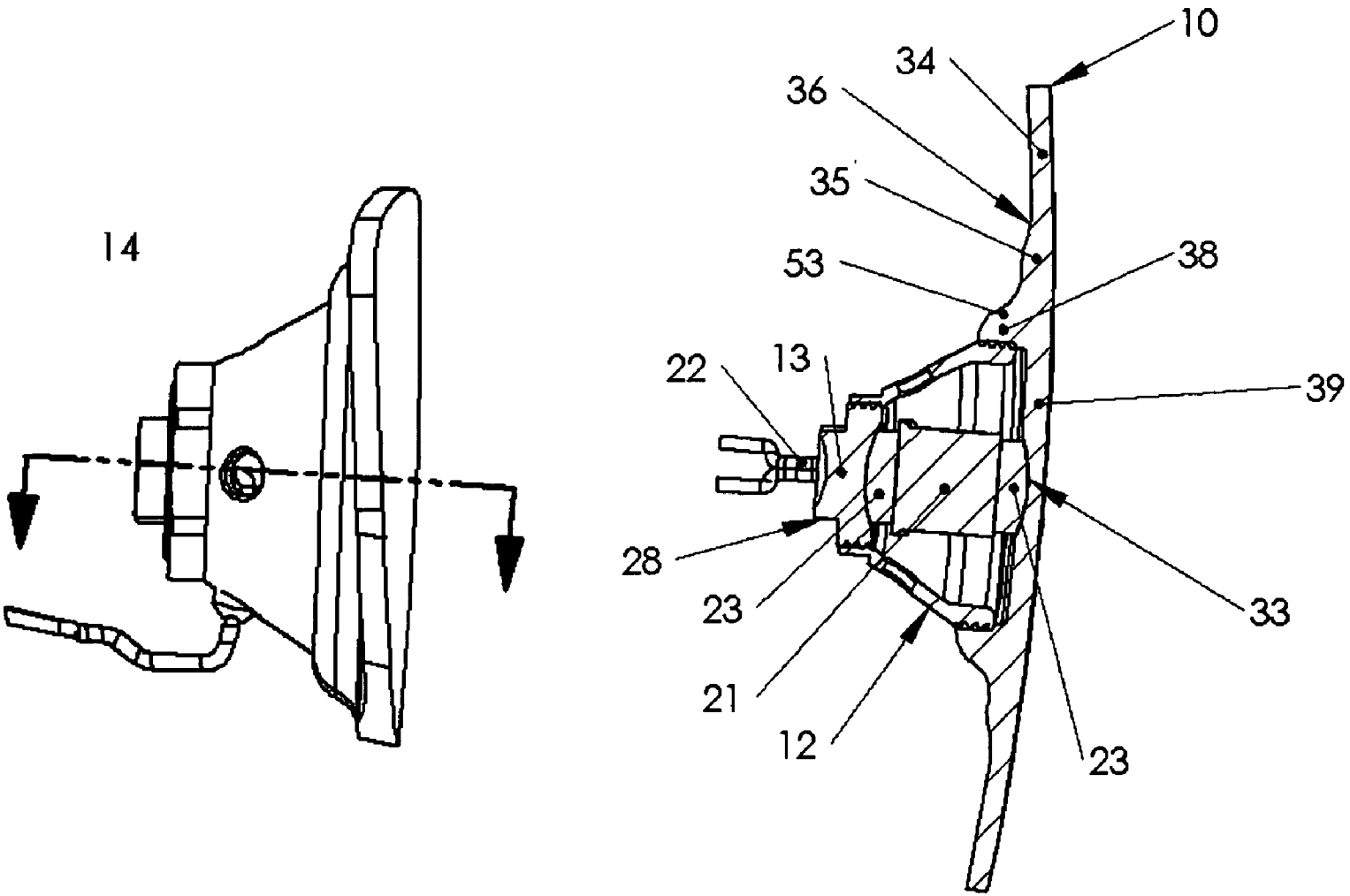

The piezoelectric element is shown in exploded view of the face subassembly in FIG. 18 and in section view of the face subassembly in FIG. 19. The piezoelectric stack itself is denoted as element 21 while the actuator assembly consisting of the stack 21 leads 22, stack end caps 23 and strain relief 25 is together taken as subassembly 15 in FIG. 18. The piezoelectric actuator 21 is preferably configured as a multi-layer stack, 3-3 type actuator. It can alternately be a monolithic rod, tube, or bar, such that electrical input generates axial actuation (motion and stress) predominately and conversely axial loads generate voltage and charge on the element. Note that 1-3 (transverse) coupled tube or system also has this effect but using a 3-3 stack minimizes voltages because the layers can be made thin and the 3-3 mode multi-layer stack utilizes the high piezoelectric coupling coefficients associated with the 3-3 mode of operation. A centrally positioned piezoelectric stack is placed between the face 10 and a backing plate (cap 13) that is structurally coupled to the face at carefully determined locations. The piezo stack has convex end caps 23 that provide a point contact with the face thereby minimizing bending moments induced on the stack due to eccentric placement in the system. This is important in this highly stressed system since it is desirable to operate the piezoelectric near its maximum allowable stress to minimize system weight while maximizing electromechanical coupling. In addition, the convex end caps 26 are designed so as to distribute the stress more uniformly though the stack resulting in more ideal stack operation and minimizing stress inhomogeneity in the stack which can cause fracture or induce stack failure under impact. The end cap thickness is determined to ensure sufficient homogeneity. In the preferred embodiment, the end caps have a radius of curvature of 12.5 mm on the rounded end and measure 3 mm from the top to the interface with the piezoelectric stack, They are formed of a stiff material such as alumina or steel to more efficiently distribute the stress to the stack in a minimal thickness/mass part. Alternately they can be composed of laminations of these materials for ease of fabrication.

The stacks 21 consist of co-fired multilayer piezoelectric elements with layer thickness in the range from 15 to 150+ microns. The systems with thinner layers have much higher capacitance and thereby have a lower necessary inductance for tuning to a given frequency than the system using thicker layers. For example, for a 9 mm diameter circular stack of 1 cm total length, if it is assembled from 90 micron layers then the stack capacitance=550 nF, while if it is assembled from 35 micron layers then the stack capacitance=3442 nF.

The stacks with thinner layers conversely also have much higher current during triggering. The higher current can lead to excess loss. The thinner layers also lead to lower voltage systems under comparable stresses that can simplify and lighten the electronics design. The preferred embodiment uses 90-100 micron thick layers. The piezoelectric material is a "hard" composition similar to typical PZT-4. It is selected so as to minimize piezoelectric hysteretic losses as well as maximize stack robustness and tolerance to high axial stresses during impact. The leads are attached such that all the piezoelectric layers act in parallel. The leads are attached to the side of the stack as shown in FIG. 18. The piezoelectric element is ~1 cm long and 9 mm in diameter. It is attached with a strong epoxy to the curved end caps with a very thin layer (so as to maximize coupling) such that the overall piezo/end cap assembly 15 is ~16 mm long.

Face and Cone Design

The objective is to couple to the face deformation during impact to maximize generated voltage and charge during impact (generated electrical energy) and also couple to a high frequency mode of the face system which can be excited by high frequency oscillations of the actuator. The system converts impact energy into high frequency oscillation of the face. High frequency face oscillation can be used to control the frictional interface between the ball and the face using concepts of reduction in interface friction by surface vibration.

The face structure is titanium of carefully controlled thickness so as to create the desirable modal structure having a high frequency mode easily excited by the piezoelectric element. The general configuration of the face, housing and piezoelectric (together the face assembly 14) is shown in assembled view in FIG. 17, exploded view in FIG. 18 and section view in FIG. 19. It consists of a piezoelectric element 21 with end caps 23 (described above) attached to the face 10 and loaded against it, by a conical housing structure 12. The piezoelectric element interfaces to the face at the center point for impacts 33. The face is manufactured with a small dimple 33 with a radius of curvature slightly larger than that of the end cap, around 13 mm, so as to provide for positive location of the stack on the face.

A conical housing 12 with an optional threaded independent end piece 13 is configured to interface with the distal end of the piezo/end cap actuator assembly 15 (opposite the face end). It likewise has a curved interface to provide for positive location of the piezoelectric end cap. The conical end cap has a threaded base 29 that screws into the threaded ring 37 on the face of the club 10 (inside surface) as shown. By threading the cone onto the face, the piezoelectric element is mechanically coupled to the face, and piezoelectric axial size changes are coupled to the face bending. The radius of the ring 56 as well as the thickness and geometry of the conical housing are carefully determined so as to minimize elastic losses and deformation between the face and the distal end of the piezoelectric element. The axial stiffness of the housing must be as high as possible to maximize piezoelectric coupling to the face deformation.

The conical housing can be configured with access holes in its sides as shown in FIG. 18 element 32. These allow stack positioning and lead egress to the electronics located elsewhere inside the club head. Care must be taken in the structural design on the face, conical housing, and piezoelectric element so as to avoid critical stress levels in these components under the repeated high impact loads. The system is designed so that the housing can be screwed onto the face to press the piezoelectric stack securely onto the face and provide a sufficiently high compressive preload on the piezoelectric element. The goal is to keep the actuation element in compression during impact and operation since piezoelectric elements do not have high tensile strengths.

The face thickness is 2.4 mm inside the cone ring 39 and 2.7 mm outside the ring in a step 35 with a gradual taper 36 down to 2.2 mm minimal thickness 34 moving radial outward from the ring. Higher thickness outside the ring is due to the increased stress due to the stiff conical housing, necessitating thicker walls in these areas. The threaded ring can be welded onto or formed with the face. It is approximately 2 mm thick and 3.5 mm high, at 38. The conical housing 12 wall thickness is approximately 1 mm.

A critical dimension is the diameter of the housing at the face attachment ring 38. This diameter is chosen as large as possible while still allowing the system to have a clean axisymmetric vibration mode at a high enough frequency so as to allow excitation of high accelerations in the face structure In the preferred embodiment the ring 38 has approximately a 35 mm diameter and a height of 4 mm. The face thickness inside the ring, 39, is 2.4 mm and is chosen to match one of its component modes (as if it were a circular plate vibrating unattached to the piezoelectric) to the first axial extension mode of the piezoelectric element. This face-piezo mode matching creates a coupled system (once the piezo is attached to the face) which has a high modal amplitude at that design frequency.

The conical housing may have a threaded end cap 13 at its distal end, the housing threaded surface 30 mating with the end cap threaded surface 27. The opening in the housing allows for a simplified assembly process. With the removable end cap design, the conical housing is attached to the face first. Then the piezoelectric element is inserted and the end cap screwed onto the conical housing preloading the piezoelectric against the face. The end cap can have a concave curved surface to mate with the piezoelectric convex end cap. The end cap 13 can have a threaded attachment 27 to the conical housing 12.

Electrical Circuitry

The general system is one which converts electrical energy—which has been "quasi-statically" generated during impact by an elastically coupled piezoelectric element which is loaded during impact. As the stress/load is applied to a piezoelectric element, the voltage and stored electrical energy builds up on that piezoelectric element. The electronics shown in FIG. 10 and FIG. 11 convert that stored electrical energy on the piezoelectric element, into a high frequency oscillatory motion of the piezoelectric element. To accomplish this conversion, there is a "switching-event" that switches an inductor L1 in FIG. 11 and L10 or L11 in FIG. 10 across the electrodes of the charged piezoelectric element at a predetermined voltage threshold. The voltage level can be predetermined to correspond to an impact of a certain magnitude or intensity and thereby only trigger the system in the event of a sufficiently intense impact so as to warrant corrective action on the spin of the ball.

The switch can also be triggered by events other than a critical voltage level. For instance the trigger can occur at the peak of the loading during impact by using peak detection circuitry which initiates when the piezoelectric voltage starts to retreat from its previous value (peak detection circuitry).

The inductor is sized such that the capacitor and the inductor oscillate at a predetermined frequency, (on the order of 120 KHz). Piezoelectric element capacitance is approximately 480 nF-600 nF, for 100 micron layer thickness at 9 mm diameter and 1 cm total length of the stack. In this system the optimal inductor L10, L11, L1 value is ~1-10 micro Henries.

In summary, the circuit design, from a high level functionality, is such that it will sense voltage level on the piezo when the piezo electrodes are open circuit, and then at a predetermined voltage level will close a switch connecting an inductor to that circuit thereby causing the piezo (which has voltage on it prior to triggering) to oscillate at high frequencies as the voltage and charge on the piezo discharge through the inductor which causes a ringing as shown in FIG. 12.

The circuits depicted in FIGS. 10, and 11 have this simple functionality of a triggered switch. As the transducer (piezoelectric) is stressed during the impact, charge and voltage build up on its electrodes, essentially storing the mechanical energy of impact that has been converted by the transducer into electrical energy. The particular circuit operates so that when the voltage reaches a critical threshold, a switch is closed to connect the capacitive piezoelectric element to an inductor. The inductor is sized such that the LC time constant of the closed electrical circuit (the electrical resonance frequency) is very near the resonant frequency of a structural mode—in this case the selected face flexural mode.

The high frequency ringing must be as efficient as possible in converting "quasi-static" energy in the piezo capacitor into the energy of the oscillation. This requires a very low loss oscillation, so that the ring-down has very low damping ratio, very high quality factor typically less then 10% of critical, preferably less than 5% of critical. This, in turn, requires very low "on" resistance switches and very low—no loss elements such as low loss inductors and no resistors in the primary connection path.

High performance in the system also implies avoidance of any parasitic loses. A typical parasitic loss is due to the charge necessary to drive the switch control circuitry or any electrical system elements such as capacitors that act to reduce the open circuit voltage that the piezo would normally be generating at impact.

Typical voltage expected to be seen on the piezo before triggering is on the order of 400v (system could see 100v to 600v). A lot of these components are going to be high voltage components, and therefore must have high breakdown voltages but at the same time very low on resistances for very little losses.

So in general the system consists of four components: 1) a piezoelectric transducer 21 with some capacitance, 2) a switch Q3 in FIG. 11 that is controlled by 3) control circuitry, and which connects an 3) inductor L1 in FIG. 11 across the piezoelectric electrodes.

It is very important that this main switch turns on very fast when the voltage on the piezoelectric element electrodes reaches a critical level (pre-determined threshold level). Having the switch turn on fast is important for reducing losses because at 120 kHz if it turns on relatively slowly, if it were to take a few micro-seconds to turn on, the loss in piezo voltage before a true ring down could occur can be quite substantial. In essence the piezo charge is bled off prior to fully connecting the inductor. This severely limits the initial and subsequent voltages of the oscillation. An ideal circuit connects the inductor onto the piezo with little or no drop in piezo voltage from its original open circuit state (prior to the initiation of the switching). In summary, in operation the system reaches a trigger threshold level and then rapidly closes a high voltage switch so that it has very little loss and the ring down initiates at the open circuit voltage level determined by the trigger event.

The block diagram of the circuit is shown in FIG. 10*a* and *b* showing the control circuit driving the switch to connect the inductor element to the terminals of the piezoelectric element. FIG. 10*a* shows a configuration in which the switch is between the piezoelectric and the inductor (high side) while 10*b* is a configuration in which the switch drain is nominally at ground (low side). The detailed circuit of the configuration in 10*b* is shown in FIG. 11. In the following section, its operation will be described making reference to the element numbers found in that figure. The operation of the principal components of the circuit is as follows:

Piezo (P1):

The circuit is connected to a piezoelectric device P1, with the high electrode of the piezoelectric device (positive voltage under stack compression) being connected to inductor L1 (FIG. 11). In FIG. 11, the piezoelectric element can be represented by a voltage source in series with a representative capacitance, C. In actuality these elements are not part of the circuit and only serve to represent the piezoelectric element for tuning purposes. This representation neglects the coupling from the electrical energy to mechanical energy and really only reflects the effects of mechanical forcing on the piezoelectric element (mechanical to electrical coupling). The capacitor C is sized to reflect the piezoelectric's open circuit capacitance; while the voltage source inputs sized to represent the open circuit voltage excursion that the piezoelectric would see under mechanical forcing in the open circuit condition (nothing attached). A more complete model for the piezoelectric would include electrical analogues to the mechanical properties such as stiffness and inertia of the piezoelectric device, as well as a transformer or gyrator coupling the mechanical and electrical domains.

Inductor (L1):

The inductor, L1, is connected to the piezoelectric element P1. It is initially floating (not connected to ground) since the switch, Q3, is open and so no current flows through it. Upon the triggering event and the subsequent closing of the main switch (Q3), the floating side of L1 is connected to ground and a closed circuit is created between the piezoelectric element and the inductor—now connected in parallel with the piezoelectric capacitance. This creates a closed LRC circuit, with the piezo acting as the capacitance, L1 acting as an inductance, and the series resistance of L1 as well as any on resistance of the main switch Q3 (and any lead resistance) acting as the R. The fundamental goal of the design is to create a highly resonant electrical circuit (low R and low damping) to allow coupling from the electrical oscillations into the mechanical oscillations of the piezo and face. For this reason, the inductor must have very low series resistance at the frequency of oscillation of the LRC circuit. This is typically in the range from 50-200 kHz. It is essential to use high quality, low loss inductors rated for high frequency operation such as in switching power supplies. For our systems, the piezoelectric capacitance is on the order from 200-600 nF (with ~400 nF most typical) and inductance values in the range from 1-12 μH are typically used to set the oscillation frequency (with ~6 μH most usual) as given by the formula=1/sqrt(LC), where f is the desired electrical resonance frequency (formula works for lightly damped systems). In our system we have chosen 3.3 μH power choke coils from Vishay IHLP5050FDRZ3R3M1 or alternately coils from Panasonic PCC-F126F (N6), which for a 8.2 μH value has a DC resistance of ~11 mΩ (and a very compact package). The tradeoff to be considered is low resistance vs. package size. Both these weigh about 3 grams each. Since the inductance value is typically a function of frequency, it is important to select an inductor which has the right value at the frequency of the resonant circuit.

Since saturation effects can be important upon switching (since the currents can be large) care must be taken to choose an inductor which will not saturate the core. The saturation changes the effective tuning and inductance value and greatly complicates the tuning process. At high current levels the magnetic fields in the coil saturate, effectively lowering the coil inductance. This can lead to difficulties in tuning the resonance, which is now amplitude dependent, and lead to excess losses on switching since the lower inductance of the saturated inductor does not act as an effective choke to limit the high currents on switching. It is desirable to choose an inductor which minimizes nonlinear effects complication tuning, such as saturation and hysteretic losses in the core Main Switch (Q3):

The main switch is one of the most critical elements of the circuit. When a predetermined threshold voltage is reached, control circuitry turns on the mosfet, Q3, by raising the gate voltage of this N-channel mosfet. Above a critical gate voltage, (~5-10 volts) the "on" resistance of the mosfet drops dramatically. The mosfet changes from an open circuit to a low on-resistance connection to ground for the inductor. Resistor, R4, is sized so that the gate is nominally at ground even in the presence of a leakage charging current from the mosfet, Q2. When the control circuit fires, the gate of Q3 is rapidly charged up to the threshold voltage and the "on" resistance of Q3 drops rapidly, essentially closing the switch. Since the charge necessary to fire the switch is derived from the piezo itself, this firing charge is completely parasitic and should be minimized to maximize initial piezo voltage levels. To this effect, a primary requirement of this mosfet is a low gate drive charge and low total gate capacitance. The mosfet also needs to operate at high source-to-drain voltages—i.e., support the piezo voltage without breakdown prior to reaching the trigger condition and firing. High breakdown voltage is therefore important. Low on resistance, typically less than 0.1 Ohms is also important since this contributes to damping in the electrical oscillation and is perhaps the primary loss mechanism for electrical energy in the system. It is also important to note that mosfets have an intrinsic diode from source to drain. This provides a reverse current path during upswings in the electrical oscillations after switching. In the present circuit, the switch, Q3, is held on during the electrical oscillations by the diode D3 which allows charge to flow onto the gate when it fires but not flow off the gate during subsequent voltage excursions during oscillation. The time constant of how long Q3 stays on after firing is determined by the combination of the gate capacitance and the resistor R4. After firing, the charge will begin to slowly leak off of the gate until the voltage threshold is passed, dramatically increasing the drain source resistance and in effect opening the switch.

Several high voltage mosfets have been sourced and evaluated there are currently two baselines, the APT30M75 from Advanced Power Technologies, and the SI4490 from Vishay Siliconex. Their comparative properties are shown below:

| Device | Vds Max | Gate source Charge | Ron at Vg = 10 V | Diode Forward voltage |
|---|---|---|---|---|
| APT30M75 | 300 V | 57 nC | 0.075 | 1.3 |
| SI4490 | 200 V | 34 nC | 0.070 Ohm | 0.75 |

These were selected based on their low gate charge and low "on" resistance while still having high voltage capability. For very high voltage systems, the preferred switch is however the STY60NM50 from ST Microelectronics, rated for 500 volts and 60 amps.

Control Circuitry:

The control circuitry is designed to raise the voltage on the gate of Q3 rapidly when a critical threshold voltage level is reached on the piezoelectric. Rapid turn on (and high gain in the control circuit) is needed to prevent high energy loss during the transition to the on state—too slow a transition limits the peak negative voltage excursion of the circuit and the subsequent ringing.

Another feature of the control circuit is that it is latching, meaning that once Q3 is turned on it stays on regardless of the piezo voltage excursions. It stays on for a period determined by the leakage of the Q3 gate drive charge through R4. R4 is typically 3 megaohms.

The control circuit operation is as follows: Q3 is initially open so the voltage at the source terminal (top) of Q3 is essentially the open circuit voltage of the piezo. At a critical voltage, determined by the Zener diodes, D4 D5 and D6, which will collectively start to conduct at the sum of the rated voltages (plus the diode drop associated with D1) current will start to conduct through D4-D6, charging up capacitor C3 and turning on transistor Q1. It is important that D4-D6 be low leakage since small leakage prematurely through D4-D6 can cause the capacitor C3, to charge up and turn Q1 on partially or prematurely. R2 is sized (typically 100 kOhm) to limit the voltage rise associated with the leakage current of the Zeners, D4-D6, and allow a discharge path for capacitor C3 (between hits). The transistor Q1, need only be rated for low voltage since its source is connected to the control supply capacitor C4 which is maintained at no higher than 28 volts by Zener D2.

The control supply capacitor C4, is charged up during the initial high voltage excursion of the piezo. It charges with a rate determined by resistor R3 (typically 5 kΩs). In the present system, this is set at about 5 kΩs allowing a charge time of approximately 100-200 μsec for a C4 value in the range of about 47 nF. In design, the resistor R3, is sized for rapid charge up after the capacitor C4 is sized. The capacitor C4 is sized such that when it is connected to the main switch Q3 gate (when Q2 switches on) it dumps its charge into the as yet uncharged Q3 gate, lowering the voltage on C4 and raising the gate voltage on Q3 to the full on condition. Therefore C4 is sized to be large enough to supply the gate charge of Q3 up to the needed ON level. Since the charge on C4 is parasitic to the piezo charge and effectively lowers the piezo voltage, it is desirable to have C4 as small as possible yet still enable needed gate voltage rise on Q3. For the selected M1s, this value can be as low as 3.3 nF, but for some of the larger main mosfets, 47 nF was needed. In practice the capacitor C4 peak voltage which is limited by the Zener, D2, is set as high as practicable while keeping the control mosfets and transistors low cost and low loss. In our circuit we chose 28 volts for the supply capacitor C4. Testing has shown that at these component values, the control circuits reduced the piezo voltage by only a small fraction of the total open circuit piezo voltage.

When the critical voltage is reached and switch Q1 is turned on, this in turn pulls down the gate of the P channel mosfet Q2, rapidly turning it on and connecting the charged capacitor C4, to the main mosfet Q3 gate. This, in turn, charges the Q3 gate up and turns Q3 on rapidly. A Fairchild BSS110 was used for the p-channel mosfet Q2. The mosfet version of the circuit has much lower leakage through from C4 to the Q3 gate. This leakage occurs when C4 is charged but switches Q2 and Q3, are nominally open. This leakage of charge onto the gate of Q3 caused premature partial switching ON of Q3. Using the mosfet in Q2 eliminates this leakage and leads to clean switching. Once the gate of Q3 is charged up, it stays charged since it charges through diode D3 and only switches back open after the gate charge has drained through R4.

Electrical Concluding Overview: The piezoelectric element, essentially and initially an open circuit, charges up. As low parasitic losses dragging the piezo voltage down reaches some threshold level that is user controllable, an electrical switch connects an inductor across the piezo and starts it oscillating at very high frequencies. That switch has to switch very rapidly to avoid losses during the transition from open circuit to closed circuit. It has to have very low on resistance and a circuit is required that fires that and powers that switch and doesn't have a lot of capacitive drain because that would lower the voltage on the piezo. The energy used to turn the switch on, is energy not available for the oscillation.

It is desirable to have the ability to be able to tune, switch out or under electrical control, switch in and change the inductors to provide variable tuning frequency.

Some circuits have a self-locking oscillation. They automatically fall into an oscillation frequency determined by feedback gain or delay gain in the circuit. It's possible this would allow locking to the piezo vibration.

It has been found useful for the system to have some external interfaces that allow probing of the voltages and signals in the system during operation. Various leads/sensors/probe points (external interfaces from the board) allow one to tune and examine the system states and conditions throughout testing and operations. The signals can be carried out by external wires, etc. without disturbing the system, or can be brought out wirelessly. The interfaces to external electronics (wired or wireless) can also be used for monitoring/telemetry and also for reprogramming of the system performance or diagnostics and data downloading.

Figure 14:
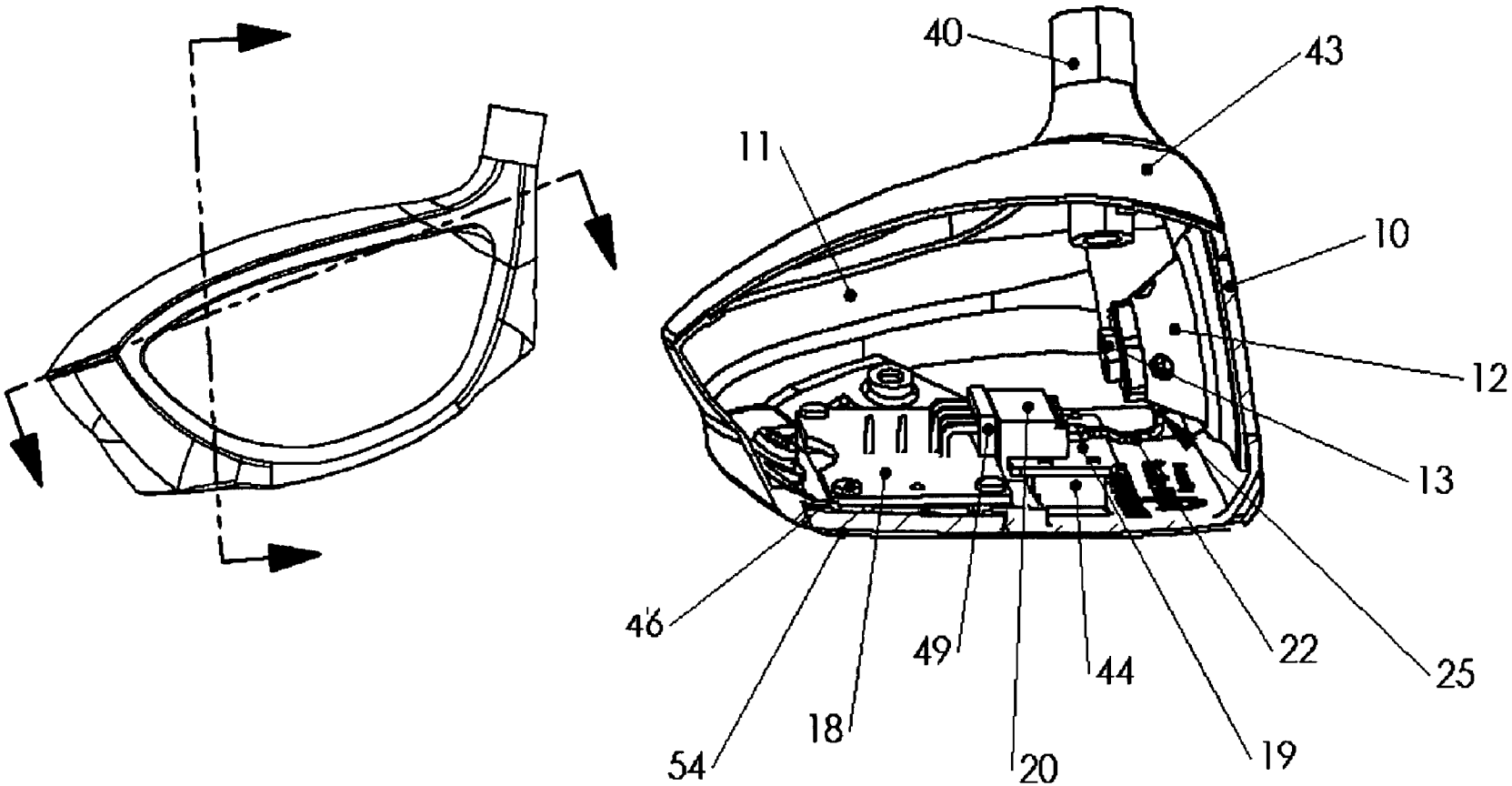
FIGS. 14-15 are section illustrations of a golf club head employing the conceptual piezo coupling embodiment of FIG. 2 to reduce the spin rate of a golf ball by converting ball impact energy into a head face vibration to reduce friction between the head and the golf ball.
Figure 15:
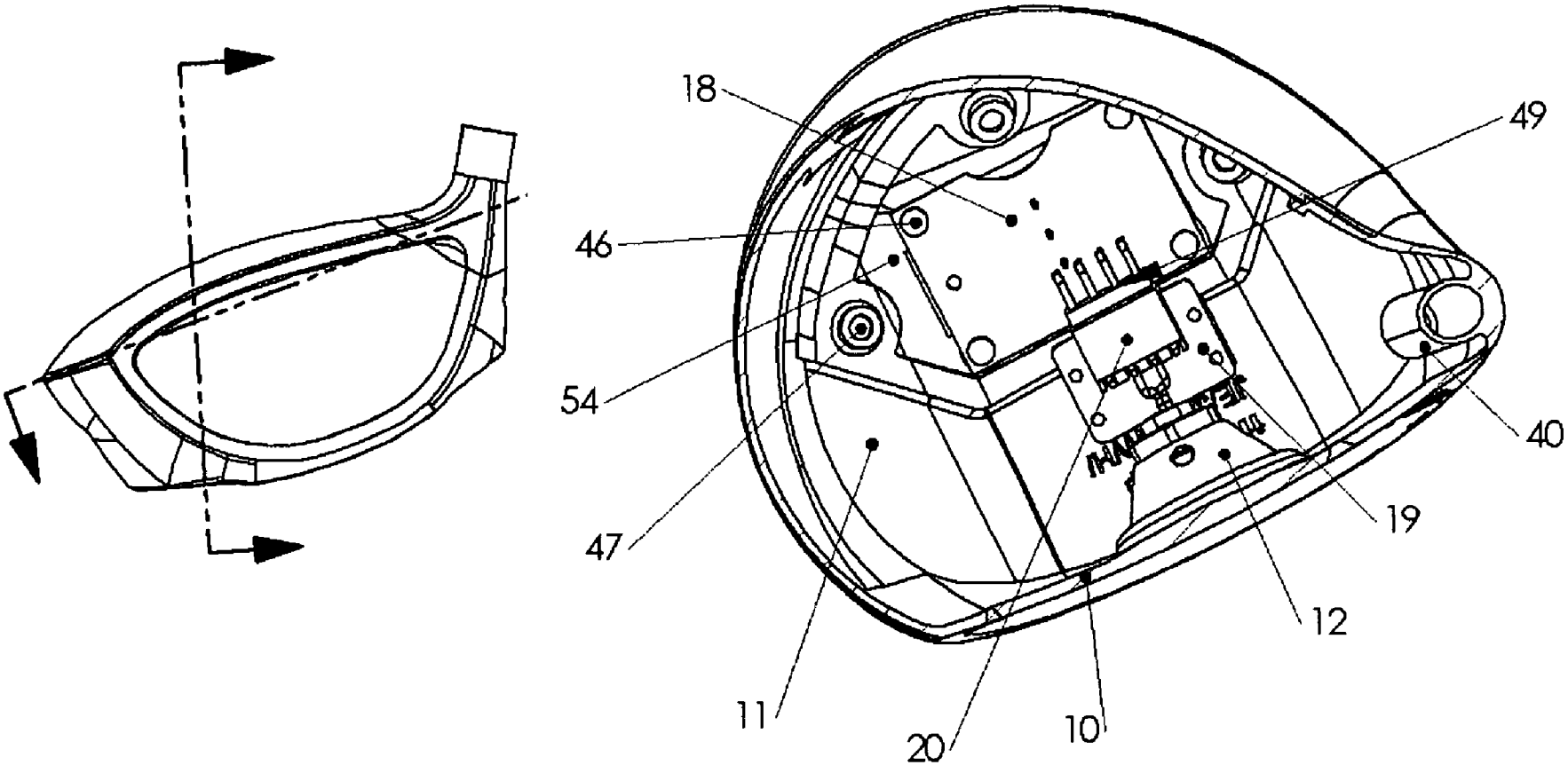
Figure 16A:
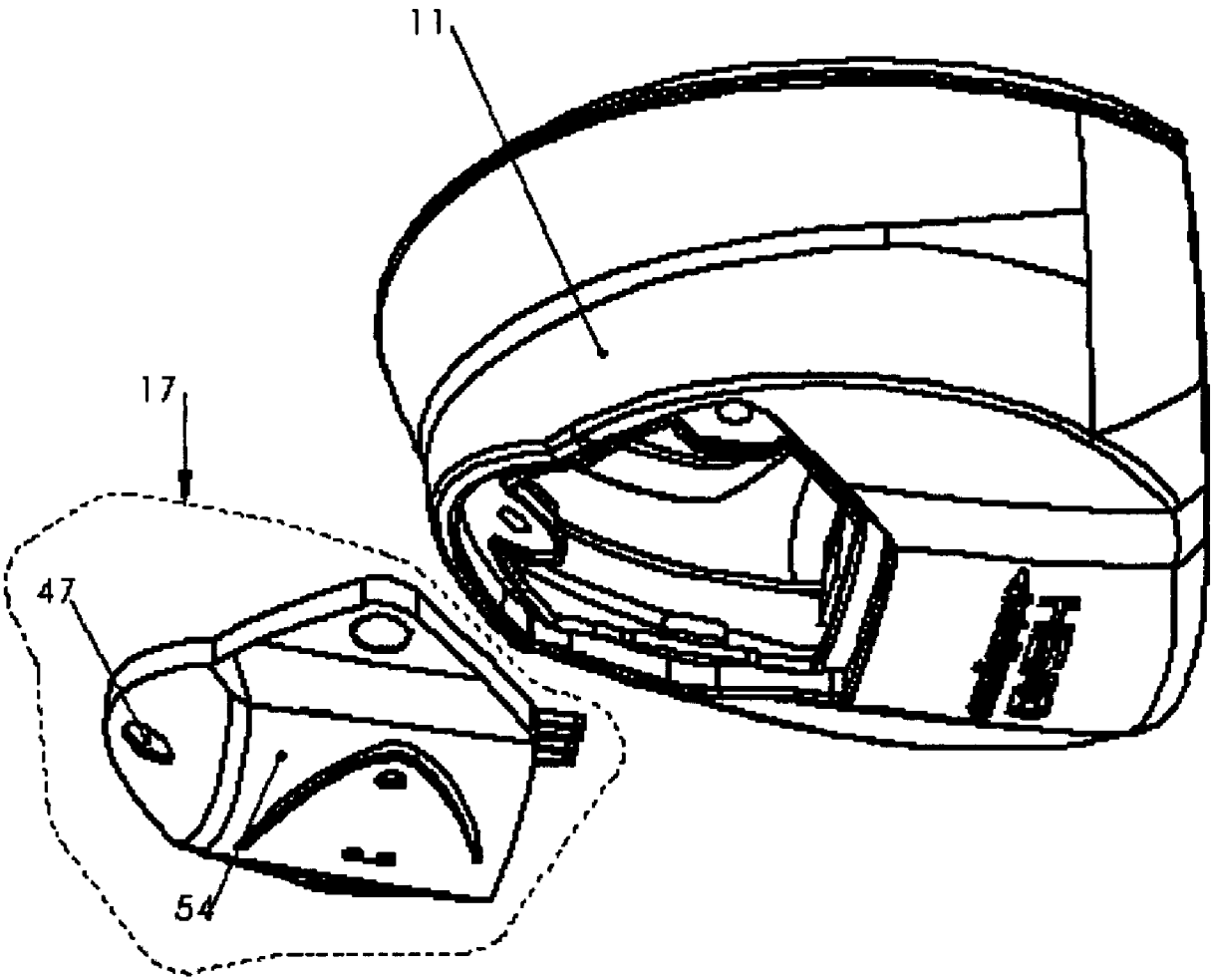
FIGS. 16*a* and 16*b* together comprise an illustration of a golf club head employing the conceptual piezo coupling embodiment of FIG. 2 detailing the removable sole plate with system electronics.
Figure 16B:
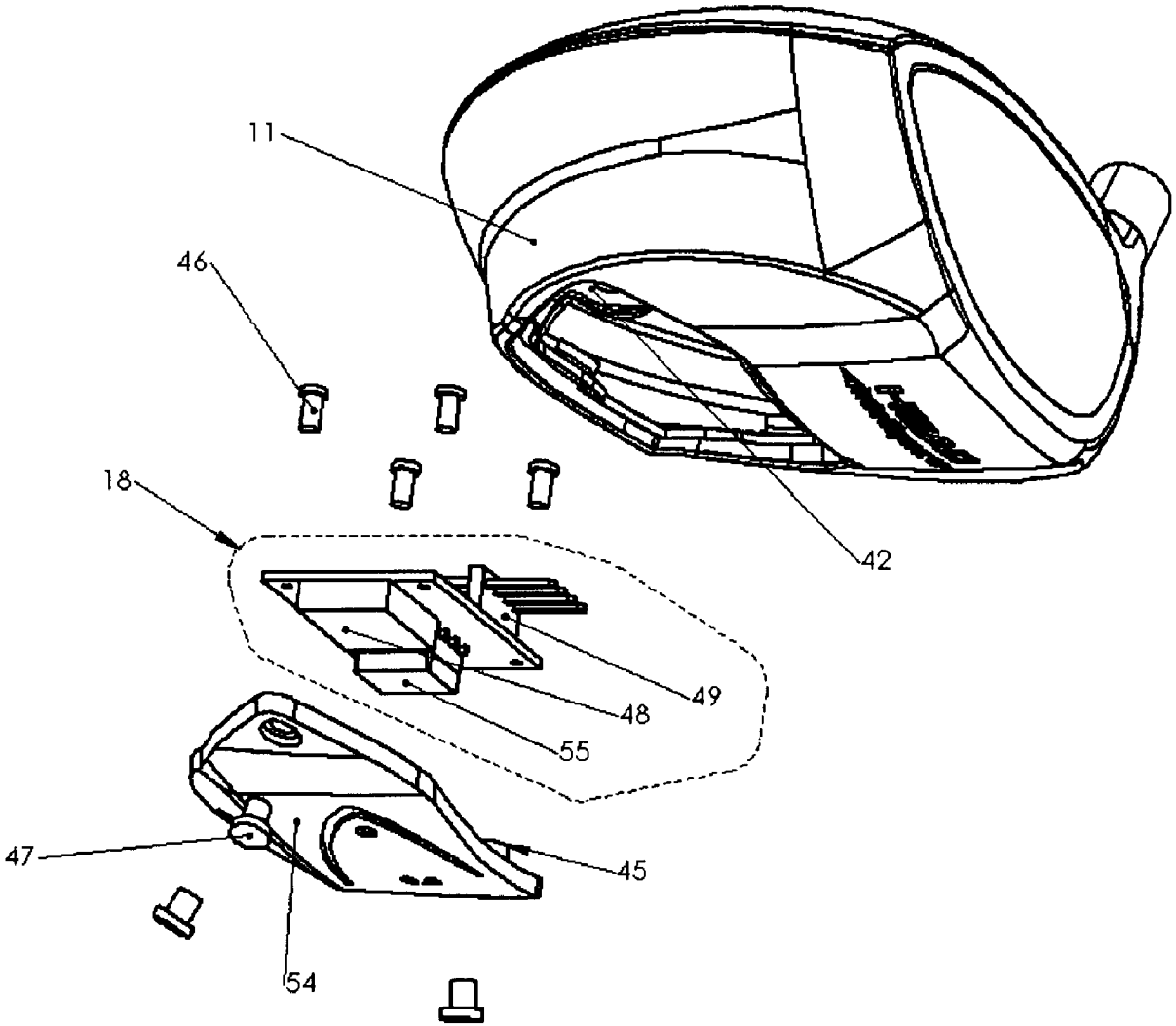

These electrical circuit elements (external to the piezoelectric element coupled to the face) are configured in a single or multiple boards on a single or multiple sides. The board is preferentially configured inside the head of the golf club or external to the club, connected by transducer leads running out of the head to the board as shown in FIGS. 13 and 14. Some or all of the components can be located on the external board to allow for easy access to the circuitry for changing trigger levels or other tuning of the circuitry. Alternately, the board 18 can be configured on a sole plate 54 (or other removable part) as part of a sole plate assembly 16 shown in FIGS. 14 and 15 attached to the head and in FIGS. 16*a* and 15*b* detached from the club head. The sole plate assembly 16 can be configured with leads 22 or plug connectors 20 so that electrical connection is made on assembly of the removable piece to the main body of the club. Such an arrangement is shown in FIGS. 14 and 15 in section view and in FIGS. 16*a* and 16*b* with sole plate assembly detached. These figures illustrate an electrical circuit board 18 mounted on a removable sole plate 54 by standoffs 45 such that when the sole plate is inserted and connected to the club body 11 by fasteners 47, an electrical connection is made between a connector on the primary board 49 and a connector 20 on a secondary "connector" board 19 which is permanently mounted in the head 11 by standoffs 44 and electrically connected to the transducer 21 and face assembly 14.

This arrangement allows for the simple removal and tuning/maintenance/repair of the electrical circuit and board. The connector and the connector board permanently mounted in the head allow the simple removal of the primary board. Additional connectors can be configured on the primary board to allow for external monitoring/diagnostics during club swings and impact. Alternately, such information can be wirelessly transmitted to a receiver and stored for later examination. Alternately the data taken during the impact event can be stored on the board in on-board memory for later dumping/downloading upon a command prompt. The telemetry transmission can occur over wireless or wired channels. Such information that can be stored and monitored includes swing speed, impact force, ball face impact location and intensity, club head deceleration and resultant ball acceleration or any of a number of system states that are associated with the dynamics and conditions of the club swing and impact (or resulting vibration of response of the ball-head system).

Assembly Procedure

In assembly the sequence of events can proceed in many orders of which one is presented below.

1) Form the face 10 with appropriately configured ring. Perform post forging machining operations to set inner diameter and thread 37 on the inner diameter of the ring. Also form and polish the dimple 33 at the location that the stack will interface when in contact with the face
2) Put a dummy threaded piece into face ring thread to hold its shape and then weld the face onto the body 11. Then remove the supporting dummy threaded piece.
3) Screw on cone 12 until tight
4) Insert piezo stack/piezo end cap assembly 15 into cone to make contact with the face. There may be a supporting element made of plastic or other flexible material , designed to hold the piezo in place/position until the end cap of the cone can be screwed on and the piezo can thereby be preloaded and against the face and locked into position. The leads of the piezoelectric 22 must be routed through the holes in the housing walls 32. These should have an appropriate grommet or strain relief to avoid abrasion during impact induced motion.
5) The end cap 13 is then screwed onto the cone (curved side interfacing with the piezoelectric stack assembly) until the piezo is securely seated and preloaded against the face sufficiently to avail breaking of contact between the face and the piezo end caps during impact (around 1000N compressive preload). A thin layer of machine oil can be used between the end caps of the piezo assembly and the face and the cone end cap to aid in seating.
6) The screw on cone end cap 13 is than locked in place with a set screw, epoxy or other method of fixation.
7) The leads of the piezo are then soldered onto a small connector board 19 that holds the connector 20 for interfacing with the primary (removable) board 18. The connector board is permanently attached into the head with epoxy or screws on a standoff 44. The connector board is positioned so as to interface to the primary board without interference.
8) The crown of the club head 43 is then bonded to the head body 11 in a 160 degree C. epoxy bonding operation.
9) The primary board 18 and connector 49 are attached to the removable sole plate 54. And the entire removable assembly 17 is then inserted into the club head and screwed in. The system is now operational.

Alternate Embodiment: Face Stiffness Control

In the forgoing sections, a method and system for achieving face-ball friction control using ultrasonic vibrations was presented. In this section an alternate embodiment using a piezo (or other) transducer coupled to a face of a golf club (putter, driver, iron) to effect stiffness control will be presented. By varying the effective face stiffness, the course and result of the ball-face impact is effected/controlled and so this is generally one example of an impact control system using solid-state transducer materials. The concepts presented in this section are described in terms of a piezoelectric transducer coupled to a face but apply more generally to a system with any transducer coupled to face motion—as long as the transducer is capable of converting mechanical energy to electrical energy and vice versa i.e. exhibits electro-mechanical coupling.

General Principle

The general concept is to utilize the aforementioned electromechanical coupling of a face-coupled transducer to change the effective stiffness of the face under prescribed conditions. In essence, one controls the stiffness of the face to produce a desirable effect from the resulting ball-face impact (with the controlled stiffness). The stiffness can be controlled because in a system with electro-mechanical coupling, changing the boundary conditions on the electrical side (ports) of the system changes the effective stiffness of the mechanical side of the system. For example, it is well known in the art that the stiffness of a shorted piezoelectric element is lower than the corresponding stiffness of an equivalent piezoelectric element with the electrodes open. This effect can be used to change the effective stiffness (longitudinal i.e., in the poling direction or shear mode, i.e., transverse to the poling direction) of the piezoelectric material and piezoelectric element. Since the piezoelectric element is mechanically coupled to the face, this change in piezoelectric element stiffness results in a change in the stiffness of the face.

In any of the transducer-face mechanical coupling embodiments presented above (Concepts 1-8), the transducer is mechanically coupled to the face in such a way that a change in the stiffness of the transducer changes the behavior of the face. In the case of the elastically coupled embodiments (Concepts 1-4), it can be said that a change in stiffness of the transducer directly changes the stiffness of the face to ball impact. This equivalently changes the deflection of the face under impact. In the inertial coupled cases (Concepts 5-8) changes in the transducer stiffness result in changes to a coupling between the face motion and an inertial mass (for Concept 8 this is the remainder of the club head)—changing the dynamic stiffness of the face if not the quasi-static stiffness (DC). This is because these inertial coupled concepts are not DC coupled. They have no effect on the system at very low frequencies since there is little inertial force from the proof mass at low frequencies. They are designed to have effect on the system at the impact timescales, however, and so a change in the transducer stiffness in these concepts results in a change in the stiffness of the system in the frequency range associated with ball impact (around 0.5 milliseconds and 1 kHz). Thus any of the Concepts 1-8 can be used to change the effective stiffness of the face under impact by varying the stiffness of the transducer.

Transducer Configurations

As mentioned above any of the previously described transducer configurations can be used as the basis for this impact control concept. For example, one embodiment uses a piezoelectric stack coupled to the face as in Concept 2. In the mechanical design presented previously for Concept 2 and shown schematically in FIGS. 2*a* and 2*b* and in detail in FIGS. 13-19, the face DC stiffness (to central ball forces normal to the face) increases approximately 25% from the short circuit case to the and open circuit scenarios. An alternate configuration to using a stack transducer is to use a planar (potentially packaged) piezoelectric transducer (or other solid state transducer material) bonded to the face and thereby coupled to face motion through coupling to face extension and bending. The face bending stiffness and thereby overall stiffness to the ball forces can be changes by changing the electrical circuit boundary conditions (open circuit or short circuit).

System Circuitry Operation

To enable the control, the transducer electrical boundary conditions must be determined (controlled) based on some response or behavior of the system. This can be determined based on the transducer itself (i.e., voltage or charge under loading) or it can be determined by an independent sensor for example face strain or face deflection sensor. An accelerometer can also be used to determine club head deceleration under impact and trigger the system accordingly.

In operation, the transducer is placed into an open circuit or short circuit condition depending on the sensor. For example the electrical connections can be controlled based on impact intensity—making the system stiffer under more intense ball impacts and less stiff under softer ball impact. This can be especially important in conditions requiring enhanced feel, longer ball dwell time and an increase in topspin or launch angle such as in putting and putters, or wedges and short iron shots.

In putting it is known in the art that the key to reducing skid is to give the ball as much topspin as possible before it leaves the putter face and it is advantageous to minimize the distance that the ball skids before it starts to roll.

The impact of a putter compresses the golf ball front to back while widening the girth for an instant. The ball then rebounds to its initial shape, causing it to propel forward from the club face. A perfect scenario would have the golf ball rebounding in a direction determined only by the direction the putter is traveling and the angle of the putter face relative to that direction. Since golf balls are not perfectly balanced, imperfections in the ball can cause deviation in the rebound direction called compression deflection. A reduction to the amount that the ball is compressed at impact reduces compression deflection. A softer face reduces interface loading and decreases the ball compression. Therefore, when properly tuned the desired effect of the system reduces ball compression deflection and optimizes launch and roll conditions. For example in putters, the combination of having a relatively soft clubface with a high rebound resilience increases control both in distance and direction.

The elastic deformation of both the ball and face materials has a tremendous influence on the direction, velocity and manner a golf ball will propel, launch or spring from a clubface after being compressed during the impact event. The effective resilience of a clubface striking a ball is a combination of the resilience of the ball and clubface. To maximize control, in putters and wedges it is better for a substantial portion of the effective resilience to come from the clubface, not from compression of the ball, to reduce compression deflection.

In contrast with this desire for more compliance in the face to increase control, in putting and shorter golf shots as the velocity of impact increases the amount of control could potentially decrease with a more compliant face due to the intensity of the impact and force of the stroke relative to percussion point. Impact induced deformations can contribute to ball trajectory errors and stroke inconsistency especially in non ideal impacts at high intensity. Essentially the increased compliance can lead to a loss of control in higher intensity impact scenarios.

To increase the control of the shot and reduce scatter, it is therefore desirable to have a clubface which has lower stiffness in lower impact intensity events but higher stiffness in higher impact intensity events.

In the preferred embodiment when the Piezo is in shorted condition and an increase in the amount of time in which the ball remains in contact with the clubface, "Dwell Time" is coupled to a clubface with high coefficient of friction, an appreciable increase in control and optimization of ball launch conditions result.

Increased dwell time enables the clubface an extended opportunity to hold the ball for the purpose of imparting topspin. It is also known that a longer dwell time improves feel.

For example in low velocity impacts with a putter the shorted Piezo enables the clubface to cradle the ball during contact, resulting in more dwell time and less skidding onto the green. Additionally this performance characteristic translates to an enhanced feel and control which is also known in the art to improve accuracy, consistency and confidence.

In contrast stiffening the face in higher velocity impacts can also increase accuracy and consistency by reducing elastic deformation induced errors. Additionally the variable stiffening effect presents a significant range of performance characteristics out of one golf club using only simple electrical circuit variations. Whereas the same range of performance characteristics in a passive golf club design would require several identically designed golf clubs with varying clubface material boundary conditions to perform at this range. Thus the idea of a electrically tunable or fittable club system is possible Wherein changing a resistor or trigger level can be used to change the club behavior to match a particular player, or playing condition.

By making the system stiffer under certain conditions during the course of impact, the impact result is being controlled. Alternately the stiffness change can be configured and fixed by the user prior to the shot, thereby enabling a kind of fitting of the club to the user. The user can select the most desirable stiffness setting and have it set at the factory or in a user controllable system, the stiffness can be set by the user prior to play—depending on the user's desires or condition of the game (weather, wind, etc). The switch or other electrical setting device can be configured for easy user access, for instance at the end of the grip.

Figure 23:
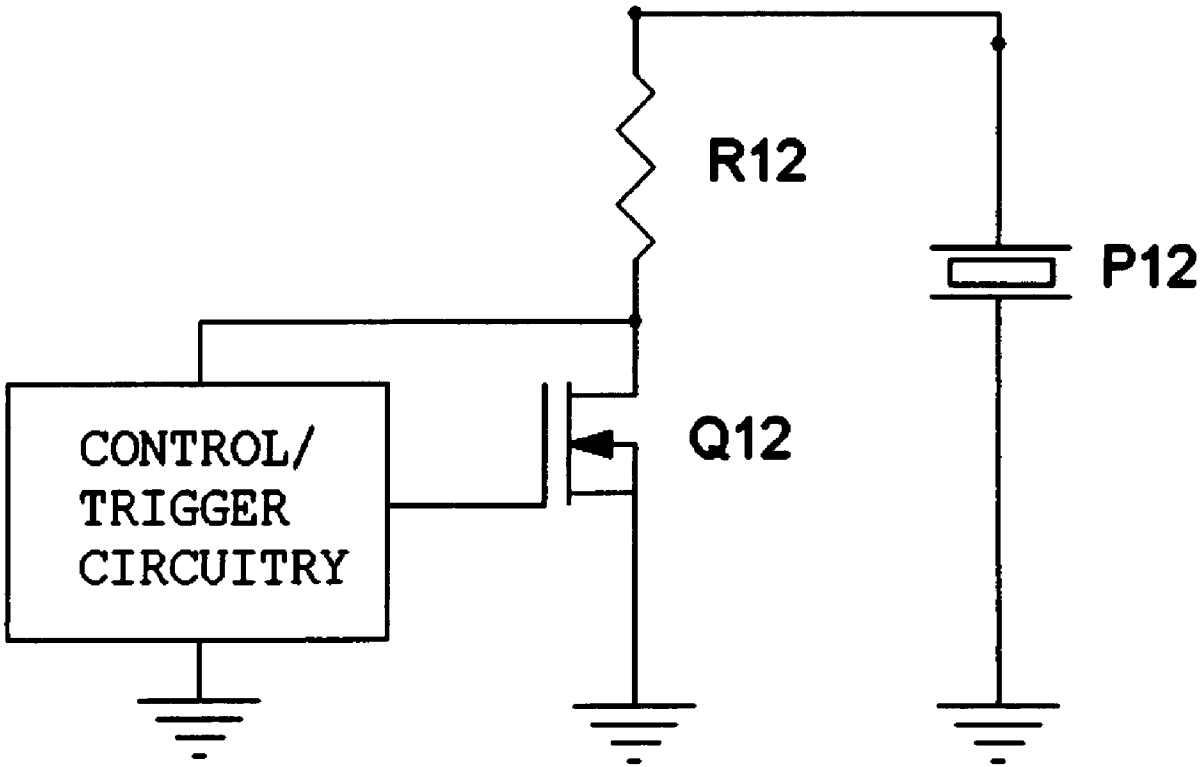
FIG. 23 is a circuit block diagram of a electrical system for achieving variable stiffness which stiffens upon mechanical excitation of the piezoelectric of sufficient intensity.

A schematic of a preferred embodiment which uses the piezoelectric itself as the impact sensor is shown in FIG. 23.

In operation, the circuit acts to open the piezoelectric electrodes in harder impact scenarios and leave them shorted in softer impact scenarios. The transducer (coupled to the face) is electrically connected to charge or voltage sensing circuitry. In essence it is configured as a sensor. The sensing circuitry keeps the piezoelectric high lead at ground, essentially shorting the piezoelectric. In this condition the piezoelectric transducer exhibits short circuit mechanical properties. If the sensor output voltage reaches a critical level, then the circuit is triggered and the switch (normally closed) which connects the piezo to the circuitry is opened, essentially opening the electrodes of the piezoelectric transducer. Upon triggering the electronics, the piezoelectric transducer then has open-circuit stiffness and the face to which it is mechanically coupled will now have higher stiffness for the remainder of the impact.

A circuit which implements this is very similar to the circuitry described above for the friction control application. The circuit is modified by replacing the inductor L1, with a resistor, R12 in FIG. 23, and the switch M1, which is an n-channel enhancement mode mosfet in the friction control circuit, is replaced with a new mosfet which is an n-channel depletion mode mosfet Q12. With a depletion mode n channel mosfet Q12, the circuit is initially in the short circuit condition i.e. the switch Q12 is closed. Upon lowering the voltage at the mosfet gate (when it triggers) the depletion mode mosfet opens the circuit, thereby disconnecting the resistor and thereby the piezoelectric electrodes. The circuit is now open circuit. The control circuit operates to lower rather than raise the gate voltage as in the friction control circuit. Such voltage driven mosfet drive circuits are common in the art.

The trigger event is set when the voltage on the piezoelectric reaches a threshold voltage sent by the Zener diode. The voltage rises because the piezo is forced to discharge through the resistor, R12, and therefore not perfectly shorted. This provides the opportunity to trigger off the voltage rise that occurs when the piezo is forced. If the piezo were truly shorted, the voltage would not rise and the trigger would not occur. Since the piezo is initially shunted by the resistor, R12 (the switch Q12 being initially closed), the voltage will rise as long as the forcing occurs at a rate on par with or greater than the RC time constant of the system. Forcing at frequencies below that associated with the RC time constant, the voltage will not rise much since the resistor appears as a short. Above this time constant (i.e., for relatively rapid forcing) the resistor appears as an open circuit and the voltage rises. The piezo essentially does not have the time to discharge through the resistor during the course of the event.

The circuit thus has the effect that impacts of sufficient rate or intensity that raise the voltage on the resistor-shunted piezo, trigger the circuit and open the depletion mode mosfet effectively opening the circuit and putting the piezo in a open circuit electrical situation. The system thus stiffens the system upon sufficiently intense or rapid impacts. The system can be tuned by selection or an appropriate shunting resistor, or (primarily) by selecting the appropriate triggering Zener breakdown voltage.

The above mentioned system is self sensing and self powering in that it draws power from no external source but rather from the charges of the face-coupled transducer itself. It should be noted that the triggering signal could be derived from an alternate sensor. In addition the feedback logic could be more complicated, perhaps even determined by a programmable microprocessor. This microprocessor could be powered from energy extracted by the circuitry from the impact event. The microprocessor could be externally programmed as a result of a fitting system to respond under predetermined conditions particular to an individual golfers characteristics and capabilities. This is the concept of a programmable smart club designed to maximize the benefit from impact derived from a given golfer's swing. The programming essentially allows the club behavior to be tuned and customized to the individual golfer and his characteristics and capabilities. For example correcting for hooks or slices.

Having thus disclosed various embodiments of the invention, it will now be apparent that many additional variations are possible and that those described therein are only illustrative of the inventive concepts. Accordingly, the scope hereof is not to be limited by the above disclosure but only by the claims appended hereto and their equivalents.

We claim:

1. A golf club head having a hitting surface for impacting a golf ball; the head comprising:

a transducer for converting mechanical energy from said surface during a golf ball impact event to electrical energy;

a circuit coupled to said transducer for selectively generating a triggering signal responsive to said electrical energy; and an actuator disposed in the golf club head mechanically coupled to said hitting surface by mounted attachment thereof and actuated responsive to said triggering signal, said actuator changing a mechanical attribute of said hitting surface and thereby altering golf ball impact in adaptively controlled manner during said impact event in response to said electrical energy.

2. The golf club head recited in claim 1 wherein said transducer comprises a piezoelectric element.

3. The golf club head recited in claim 1 wherein said actuator comprises a piezoelectric element.

4. The golf club head recited in claim 1 wherein said transducer and said actuator both comprise a common piezoelectric element.

5. The golf club head recited in claim 4 wherein said piezoelectric element is coupled to said hitting surface.

6. The golf club head recited in claim 4 further comprising a support structure within said head, said support structure maintaining firm contact between said hitting surface and said piezoelectric element.

7. The golf club head recited in claim 6 wherein said support structure comprises a conically shaped housing.

8. The golf club head recited in claim 1 further comprising a support structure within said head, said support structure maintaining firm contact between said hitting surface and said actuator.

9. The golf club head recited in claim 8 wherein said support structure comprises a conically shaped housing.

10. The golf club head recited in claim 1 wherein said actuator is configured to cause said hitting surface to vibrate at a selected frequency while said golf ball is being impacted by said hitting surface.

11. The golf club head recited in claim 1 wherein said actuator is configured to cause said hitting surface to vibrate at an ultra-sonic frequency.

12. The golf club head recited in claim 1 wherein said actuator is configured to cause said hitting surface to vibrate at a frequency and with an amplitude sufficient to interrupt contact between said hitting surface and said golf ball.

13. The golf club head recited in claim 1 wherein said circuit comprises a reactive impedance for storing said electrical energy.

14. The golf club head recited in claim 1 wherein said circuit comprises a reactance for storing said electrical energy.

15. The golf club head recited in claim 1 wherein said circuit comprises an inductor for storing said electrical energy.

16. The golf club head recited in claim 1 wherein said circuit comprises an inductor and a capacitor for storing said electrical energy.

17. The golf club head recited in claim 1 wherein said circuit comprises a switch for selectively applying said electrical energy in response to a threshold parameter of said hitting surface impacting said golf ball.

18. The golf club head recited in claim 17 wherein said parameter is the magnitude of an electrical voltage produced by said transducer in response to said impacting.

19. The method recited in claim 17 wherein said converting steps are each carried out using a piezoelectric element mechanically coupled to said face.

20. A golf club head having a ball impacting face for hitting a stationary golf ball, the head comprising;

a transducer disposed in the golf club head and coupled to said ball impacting face by mounted attachment thereof for converting first mechanical energy of golf ball impact during an impact event into input electrical energy and for converting output electrical energy into second mechanical energy, said transducer by said second mechanical energy changing a mechanical attribute of said ball impacting face in adaptively controlled manner during said impact event; and a circuit coupled to said transducer for receiving said input electrical energy and supplying said output electrical energy;

said input electrical energy being a pulse signal responsive to the first mechanical energy and said output electrical energy being an oscillating signal.

21. The golf club head recited in claim 20 wherein said second mechanical energy is a vibration having a frequency of said oscillating signal.

22. The golf club head recited in claim 21 wherein said vibration is applied to said face to intermittently interrupt contact between said face and said golf ball.

23. The golf club head recited in claim 20 wherein said transducer comprises a piezoelectric element.

24. The golf club head recited in claim 23 wherein said piezoelectric element is mechanically coupled to said face.

25. The golf club head recited in claim 23 further comprising a housing within said head, said housing affixed internally to said face and enclosing said piezoelectric element.

26. A method of reducing the effective coefficient of friction between the face of a golf club head and a golf ball; the method comprising the steps of:

establishing a transducer in said golf club head electromechanically coupled to said face by mounted attachment thereof; and, automatically actuating said transducer to convert the energy upon ball impact with said face during an impact event into an electro-mechanically actuated ultra-sonic vibration of said face to thereby change a mechanical attribute of said face for the interaction of said face and said ball in adaptively controlled manner during said impact event.

27. The method recited in claim 26 wherein said converting step comprises the steps of:

converting said ball impact energy into electrical energy; and converting said electrical energy into said ultra-sonic vibration.

28. A method of altering the interaction between a golf club head hitting surface and a golf ball being impacted by the hitting surface; the method comprising the steps of:

coupling a piezoelectric element disposed in the golf club head to said hitting surface by mounted attachment thereof to generate a first electrical signal in response to said hitting surface impacting said golf ball during an impact event;

converting said first electrical signal into a selected second electrical signal;

selectively connecting said second electrical signal to said piezoelectric element, said piezoelectric element changing a mechanical attribute of said hitting surface responsive to said second electrical signal to thereby alter the behavior of said golf ball in adaptively controlled manner during said impact event.

29. The method recited in claim 28 wherein said mechanical effect is a vibration of selected frequency and wherein said behavior is the induced rate of spin of said golf ball.

30. A golf club head comprising:

a hitting surface; and, a device disposed in the golf club head coupled to said hitting surface by mounted attachment thereof for automatic electro-mechanical actuation responsive to impact of said hitting surface with a golf ball during an impact event, said device actively stiffening said hitting surface in adaptively controlled manner during said impact event when the force of said impact exceeds a selected threshold.

31. The golf club head recited in claim 30 wherein said device comprises a sensor for sensing said force of said impact and a transducer in contact with said hitting surface and having at least two distinct levels of stiffness depending upon whether said impact force is above or below said threshold.

32. The golf club head recited in claim 31 wherein said sensor comprises a piezoelectric element.

33. The golf club head recited in claim 31 wherein said transducer comprises a piezoelectric element.

34. The golf club head recited in claim 31 wherein said sensor and said transducer each comprise a piezoelectric element.

35. The golf club head recited in claim 31 wherein said sensor and said transducer comprise a common piezoelectric element.

36. A golf club head comprising:

a hitting surface; and, a variable stiffening element disposed in the golf club head coupled to said hitting surface by mounted attachment thereof for automatic electromechanical actuation, said variable stiffening element selectively increasing and decreasing the stiffness of said hitting surface of said head in adaptively controlled manner during an impact event responsive to sensed impact with a ball during said impact event.

37. The golf club head recited in claim 36 wherein said stiffening element comprises a piezoelectric element having a first level of stiffness when a short circuit configuration is generated there across and a second level of stiffness when open circuit configuration is generated thereacross.

38. The golf club head recited in claim 37 wherein the configuration of said piezoelectric element is determined by a switch.

* * * * *